US007513962B2

(12) United States Patent
de Figueredo et al.

(10) Patent No.: US 7,513,962 B2
(45) Date of Patent: Apr. 7, 2009

(54) ALLOY SUBSTANTIALLY FREE OF DENDRITES AND METHOD OF FORMING THE SAME

(75) Inventors: Anacleto M. de Figueredo, West Newton, MA (US); Diran Apelian, West Boylston, MA (US); Matt M. Findon, Monson, MA (US); Nicholas Saddock, S. Windson, CT (US)

(73) Assignee: Worcester Polytechnic Institute, Worcester, MA (US)

( * ) Notice: Subject to any disclaimer, the term of this patent is extended or adjusted under 35 U.S.C. 154(b) by 146 days.

(21) Appl. No.: 10/668,668

(22) Filed: Sep. 23, 2003

(65) Prior Publication Data

US 2004/0099351 A1 May 27, 2004

Related U.S. Application Data

(60) Provisional application No. 60/412,992, filed on Sep. 23, 2002.

(51) Int. Cl.
*C22F 1/04* (2006.01)
*B22D 27/08* (2006.01)

(52) U.S. Cl. ..... 148/549; 148/538

(58) Field of Classification Search ..... 75/708, 75/333; 164/113, 133; 148/549, 538
See application file for complete search history.

(56) References Cited

U.S. PATENT DOCUMENTS 5,464,053 A * 11/1995 Moschini ..... 164/460
5,520,460 A * 5/1996 Lantz ..... 366/337
5,701,942 A 12/1997 Adachi et al.
5,979,534 A 11/1999 Shibata et al.
6,311,759 B1 11/2001 Tausig et al.
6,432,160 B1 8/2002 Norville et al.
6,645,323 B2 * 11/2003 Flemings et al. ..... 148/538
6,742,567 B2 * 6/2004 Winterbottom et al. ..... 164/113
6,908,590 B2 * 6/2005 DasGupta ..... 420/534
2002/0096231 A1 7/2002 Flemings et al.
2002/0134471 A1 9/2002 Motegi et al.
2002/0153643 A1 10/2002 Norville et al.
2003/0062144 A1 4/2003 Aoyama et al.

(Continued)

FOREIGN PATENT DOCUMENTS

EP 0 392 998 A1 10/1990

(Continued)

OTHER PUBLICATIONS

Metals Handbook, 9th Edition, vol. 15, Casting, ASM International, Sep. 1988.*

(Continued)

*Primary Examiner*—Roy King
*Assistant Examiner*—Jie Yang
(74) *Attorney, Agent, or Firm*—Hamilton, Brook, Smith & Reynolds, P.C.

(57) ABSTRACT

Described herein are alloys substantially free of dendrites. A method includes forming an alloy substantially free of dendrites. A superheated alloy is cooled to form a nucleated alloy. The temperature of the nucleated alloy is controlled to prevent the nuclei from melting. The nucleated alloy is mixed to distribute the nuclei throughout the alloy. The nucleated alloy is cooled with nuclei distributed throughout.

33 Claims, 12 Drawing Sheets

U.S. PATENT DOCUMENTS

| | | | |
|---|---|---|---|
| 2003/0079854 | A1 | 5/2003 | Flemings et al. |
| 2003/0102103 | A1 | 6/2003 | Lombard et al. |

FOREIGN PATENT DOCUMENTS

| | | | |
|---|---|---|---|
| EP | 0 719 606 | A1 | 7/1996 |
| EP | 0 745 694 | A1 | 12/1996 |
| EP | 0 841 406 | A1 | 5/1998 |
| GB | 2 100 613 | A | 1/1983 |
| JP | 08 257722 | A | 10/1996 |

OTHER PUBLICATIONS

Zoqui et al., Morphological evolution of SSM A356 during partial remelting, Materials Science and Engineering, A325 (2002), pp. 38-53, Feb. 2002.*

Alem, N., "Novel Methods of Aluminum Grain Refinement". A thesis, Worcester Polytechnic Institute, Feb. 2002.

Anacleto de Figueredo, et al., "Processing Routes", *Science and Technology of Semi-Solid Metal Processing*, Chapter 2, pp. 2-1:2-17, (IL:North American Die Casting Association, Copyright 2001).

Findon, M., et al., "The Continuous Rheoconversion Process for Production of High-Quality Semisolid Slurries", presented at 7th International Conference on Semi-Solid Processing of Alloys and Composites, Metal Processing Institute, WPI, Massachusetts (Sep. 26, 2002).

Findon, M., et al., "Melt Mixing Approaches for the Formation of Thixotropic Semisolid Metal Structures", presented at S2P Conference, Japan (Sep. 24, 2002).

Ji, S., et al., "Solidification Behavior of Sn-15 Wt Pct Pb Alloy under a High Shear Rate and High Intensity of Turbulence during Semisolid Processing", *Metallurgical and Materials Transactions*, vol. 33A, 3511:3520, Nov. 2002.

Martinez, R., et al., "Efficient Formation of Structures Suitable for Semi-Solid Forming", presentation of the North American Die Casting Association at *Trasactions*, 21st International Die Casting Congress & Exposition, Oct. 29-Nov. 1, 2001.

Wabusseg, H., "Process and Alloy Development For High Quality Aluminium Components for Lightweight Construction—The New Rheocasting Process", a dissertation submitted to the Swiss Federal Institute of Technology, Jan. 2002.

Matthew M. Findon, Semi-Solid Slurry Formation Via Liquid Metal Mixing (thesis dated Jul. 2003, and scheduled to be published Jul. 2004).

Matthew M. Findon, Semi-Solid Slurry Formation Via Liquid Metal Mixing (thesis defense notification posted Jul. 7, 2003, and available on the world-wide web at http://www.me.wpi.edu/MTE/News/thesis2.html as of Feb. 18, 2004).

* cited by examiner

ALLOY SUBSTANTIALLY FREE OF DENDRITES AND METHOD OF FORMING THE SAME

RELATED APPLICATION

This application claims the benefit of U.S. Provisional Application No. 60/412,992, filed on Sep. 23, 2002, the entire teachings of which are incorporated herein by reference.

GOVERNMENT SUPPORT

The invention was supported, in whole or in part, by grant DE-FC 36-02ID 14232 from the Department of Energy. The Government has certain rights in the invention.

BACKGROUND OF THE INVENTION

Semi-solid metal (SSM) processing is a technology that resulted from research in the early 1970's at the Massachusetts Institute of Technology. It was found that imposing a shear on a liquid metal before the solidification process began and continuing the shear while the liquid cooled below its liquidus resulted in a non-dendritic microstructure with a shear stress (and corresponding viscosity) nearly three orders of magnitude lower than that of the dendritic material. At rest, the non-dendritic metal slurry behaved as a rigid material in the two-phase region; that is, its viscosity was high enough that it could be handled as a solid. However, when a shear stress was applied, the viscosity decreased dramatically so that the material behaved more like a liquid. Thus, the slurry could flow in a laminar fashion, with a stable flow front, as opposed to the turbulent flow characteristic of molten metal.

A property of semi-solid metal ("slurry") that renders it superior to conventional casting processes is the non-turbulent ("laminar" or "thixotropic") flow behavior that results when one enters the "two-phase" field of solid plus liquid. Specifically, shearing of semi-solid slurry leads to a marked decrease in viscosity, so that a partially frozen alloy can be made to flow like a non-Newtonian fluid. Thixotropic flow behavior arises from the ideal SSM microstructure of small, spherical particles (e.g., $\alpha$-Al) suspended in a liquid matrix. In all semi-solid processes, it is imperative that this microstructure be produced consistently. Moreover, a uniform distribution of this microstructure throughout a volume of slurry is essential for production of high-quality components.

The benefits that semi-solid processing holds over conventional liquid metal casting result from the flow behavior of the partially solidified metal. The way in which a metal fills a mold (or die cavity) directly impacts the solidification of the metal; thus, the properties of the formed part can be enhanced with improved mold filling. Turbulent flow of liquid metal into a die or mold can lead to incorporation of air and mold gases into the melt. This in turn can lead to both macro- and micro-porosity in the final part, which negatively affect its mechanical properties.

There are several reasons that the laminar flow of semi-solid slurries is very advantageous from a casting standpoint. The first major reason is the elimination of gas entrapment, resulting in decreased porosity and oxide content in the formed part. Secondly, since semi-solid metal has lower heat content than superheated molten metal, there is less solidification shrinkage in the casting. Thus, molds can be filled more effectively and uniformly, and less post-casting machining is required. As a result, all semi-solid processes are potentially "near net-shape" processes. The reduced heat content also lowers the thermal stresses of the casting apparatus (typically a steel die) that contacts the metal, leading to longer tool life. Also, since the starting material has the thixotropic microstructure, the microstructure of any part formed with semi-solid processing is always equiaxed and non-dendritic. Therefore, the mechanical properties of the final component are better than a similar part formed from a conventional casting process.

The net result of the above-described advantages is that semi-solid casting can be used to produce intricate components with superior mechanical properties. The typical defects associated with molten metal casting can be circumvented when the microstructure (and thus the flow behavior) of the slurry is controlled. From an economic standpoint, it is expected that due to improved tool life, shorter cycle times, reduced machining, and ability to use less expensive heat treatment schedules, semi-solid processes will ultimately become as cost-effective as conventional casting routes such as high pressure die casting. Perhaps the most attractive attribute of semi-solid forming, however, is that due to the laminar flow of the slurry, very complex shapes can be cast, with thin walled sections on the order of millimeters.

A number of processes have been designed to take advantage of the unique behavior of semi-solid metal slurries. These processes produce the thixotropic microstructure through some method of vigorous agitation during solidification. It was hypothesized that the induced agitation broke up (or facilitated the melting off of) dendrite arms, which then ripened and spheroidized to form a non-dendritic structure.

There are two routes for processing semi-solid metal, i.e. two different ways to arrive at the desired point within the solid-liquid, two-phase region. The first route starts from the solid state ("thixocasting"), and the second starts from the liquid state ("rheocasting").

Thixocasting processes start out with a solid precursor material ("feedstock") that has been specially prepared by a billet manufacturer, and then supplied to the casting facility. The feedstock metal has an equiaxed, non-dendritic microstructure. Small amounts or "slugs" of this alloy are partially melted by reheating into the semi-solid temperature range, leading to the thixotropic structure. In most applications, the slug is subsequently placed directly into a shot sleeve of a die casting apparatus, and the part is formed.

During the initial years of SSM process development, mechanical stirring was used in various ways to break up dendrites and produce thixotropic metal structures. The combination of rapid heat extraction and vigorous melt agitation was effected by using different sizes, shapes, and velocities of stirring rods. Various researchers addressed the evolution of the "stircast" structure during this time. Although these methods worked well in that they effectively produced the desired metal structures, erosion of the stirrer became the "weak link" of the process.

Magnetohydrodynamic (MHD) casting process has been utilized to overcome the limitations associated with the use of stirrers. In this approach, dendrites are still formed and then broken from the nuclei by agitation. The source of the agitation is not a mechanical stirrer, but alternating electromagnetic fields. Induction coils are placed around a crucible to induce these forces. The crucible is equipped with a cooling system to initiate freezing in the alloy while the melt is exposed to the electromagnetic forces. Upon cooling down to ambient temperature, the alloy has an equiaxed, non-dendritic microstructure. However, the MHD stirring process requires complicated and expensive machinery.

Thixoforming processes comprise the majority of industrial semi-solid applications used today. Rather than producing a semi-solid slurry directly from a superheated melt, a specially prepared feedstock metal is heated to form the semi-solid slurry. This approach eliminates the need for melting equipment within the SSM casting facility. However, the special feedstock must be purchased from special manufacturers at a premium in the form of metal billets, therefore thixocasting processes are not economical compared to conventional processes. Furthermore, in thixocasting processes, scrap metal must be sent back to the billet manufacturer and cannot be recycled. Most importantly, process control is difficult in thixocasting, because solid fraction (and corresponding viscosity) is sensitive to temperature gradients in the reheated material. Thus, narrow temperature ranges must be achieved consistently for successful operations. This, combined with the time it takes (several minutes on average) to reheat the feedstock to the desired solid fraction, negatively affects productivity.

The development of ideal one-step rheocasting applications is highly preferable to the current two- or three-step applications associated with most thixocasting methods. Current thixocasting approaches are inherently batch processes, in which only small amounts of slurry can be produced during each forming operation. This places limits on the sizes and shapes of parts produced in this manner. A continuous process would circumvent these hindrances, and could be used for a broader variety of applications.

To date, none of these processes has satisfactorily addressed the need for providing a continuous semi-solid casting route. The current need in the SSM field is a relatively simple, easy-to-implement, flexible process that can be used for a wide variety of processing applications. Such a process should use relatively simple methods of melt agitation to avoid the problems associated with the previously discussed approaches.

SUMMARY OF THE INVENTION

This invention includes methods and processes for forming a semi-solid slurry.

In one embodiment, this invention includes a method for forming an alloy substantially free of dendrites, comprising the steps of cooling a superheated alloy to form a nucleated alloy, wherein the nucleated alloy includes a plurality of nuclei, wherein essentially all of said nuclei are substantially free of entrapped liquid; controlling the temperature of the nucleated alloy to prevent the nuclei from melting; mixing the nucleated alloy to distribute the nuclei throughout; and cooling the nucleated alloy with nuclei distributed throughout, thereby forming an alloy substantially free of dendrites.

In another embodiment, this invention includes a continuous process for forming an alloy substantially free of dendrites, comprising the steps of directing a superheated alloy stream into a reactor, wherein the superheated alloy stream is continuously cooled and mixed to form a nucleated alloy stream, wherein the nucleated alloy stream includes a plurality of nuclei distributed throughout, wherein essentially all of said nuclei are substantially free of entrapped liquid; and continuously controlling the temperature of the nucleated alloy stream to prevent the nuclei from melting and continuously mixing the nucleated alloy stream to distribute the nuclei throughout, thereby continuously forming an alloy substantially free of dendrites.

In yet another embodiment, this invention includes a method for forming an alloy substantially free of dendrites, comprising the steps of cooling a superheated alloy to form a nucleated alloy, wherein the nucleated alloy includes a plurality of nuclei substantially free of entrapped liquid; controlling the temperature of the nucleated alloy to prevent the nuclei from melting and passively mixing the nucleated alloy to distribute the nuclei throughout; and cooling the nucleated alloy with nuclei distributed throughout, thereby forming an alloy substantially free of dendrites.

In a further embodiment, this invention includes a method for forming an alloy substantially free of dendrites, comprising the steps of superheating a first metal; superheating a second metal; mixing the first and second metals to form a superheated alloy; cooling the superheated alloy to form a plurality of nuclei substantially free of entrapped liquid; mixing the superheated alloy to distribute the plurality of nuclei throughout the superheated alloy; controlling the temperature of the superheated alloy to prevent the nuclei from remelting; and cooling the superheated alloy while the nuclei are distributed throughout, thereby forming an alloy substantially free of dendrites.

In still further embodiments, this invention includes an alloy substantially free of dendrites formed by a method comprising the steps of cooling a superheated alloy to form a nucleated alloy, wherein the nucleated alloy includes a plurality of nuclei substantially free of entrapped liquid; controlling the temperature of the nucleated alloy to prevent the nuclei from melting; mixing the nucleated alloy to distribute the nuclei throughout; and cooling the nucleated alloy with nuclei distributed throughout, thereby forming an alloy substantially free of dendrites.

The present invention has many advantages. This invention provides for semi-solid metal production process simplicity, control over semi-solid metal structure evolution, and the fast adjustment of physical characteristics of the slurry produced (e.g., solid fraction and the size of nuclei). This invention allows for the production of semi-solid slurries without the need to break up dendrites through external stirring of the metal slurry. Hence, this invention eliminates the need to use, repair, replace, and maintain mechanical stirring rods or expensive and complicated electromagnetic stirring mechanisms.

Also, this invention allows for semi-solid applications that do not need expensive, specially produced feedstocks (e.g., billets) or the associated recycling of such feedstocks, which can be complicated, time consuming, and expensive. By eliminating the need for specialty feedstock, this invention eliminates the time consuming step of reheating such a feedstock. In addition, not only does this invention eliminate the rigors associated with returning scrap feedstock to a feedstock supplier, but it also allows a practitioner to immediately reuse waste materials.

This invention provides continuous processes for producing semi-solid metal slurries. These continuous processes allow semi-solid metal slurries to be used in a much broader range of applications and relax the size and shape limitations imposed by the use of batch processes.

BRIEF DESCRIPTION OF THE DRAWINGS

The foregoing and other objects, features, and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention. All parts and percentages are by weight unless otherwise indicates. All temperatures are in degrees Centigrade unless otherwise indicated.

DETAILED DESCRIPTION OF THE INVENTION

Figure 1:
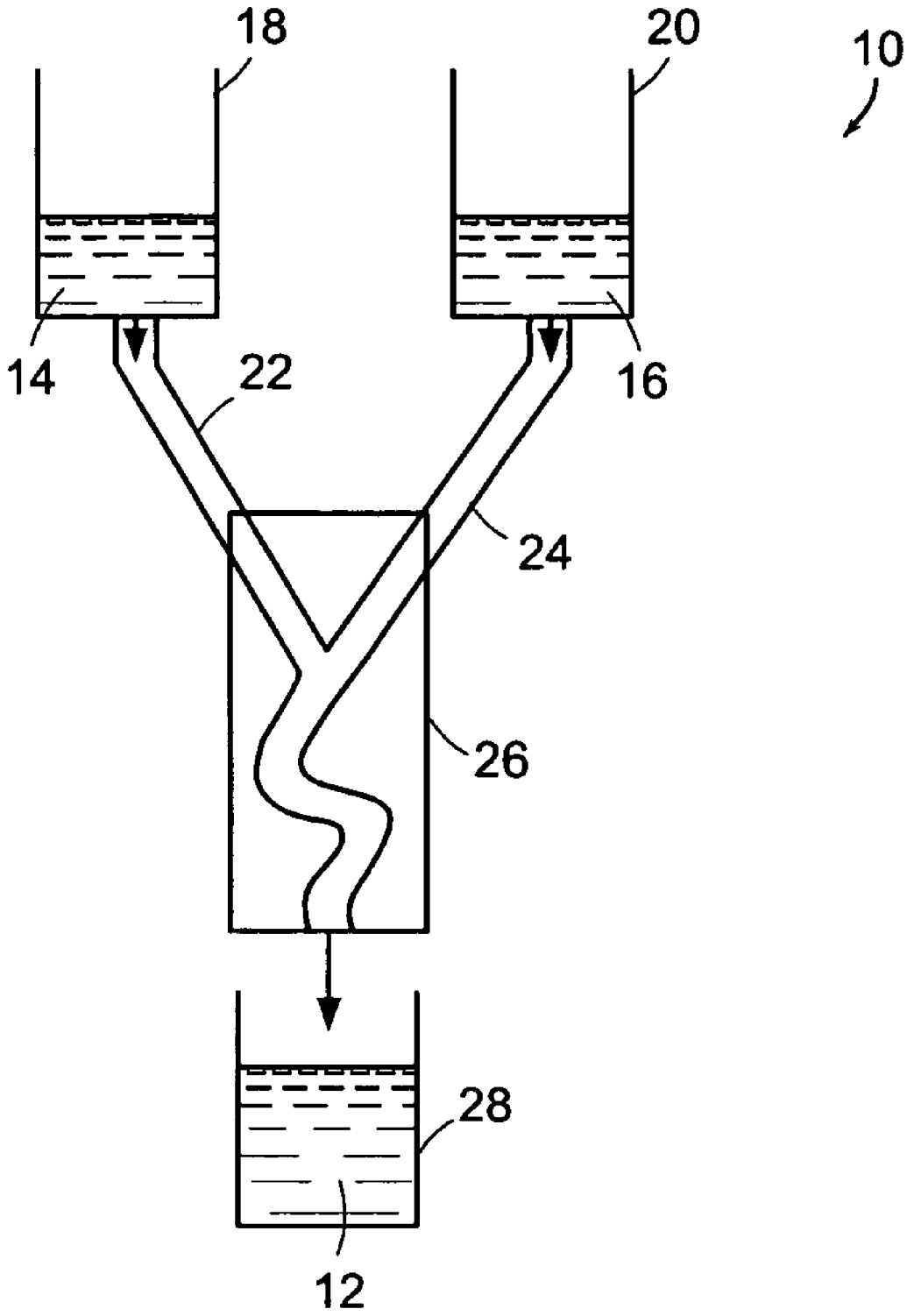
FIG. 1 shows a schematic diagram of an apparatus for producing an alloy substantially free of dendrites.

It has been advantageously discovered that the copious nucleation of a primary phase during the early stages of solidification coupled with forced convection due to complex fluid flow can result in the formation of semi-solid metal (i.e., "SSM") slurries useful in applications where thixotropic flow behavior of a metal alloy is advantageous and/or necessary (e.g., semi-solid processing applications). By controlling the temperature distribution, it is possible to maximize effective nucleation rates in the solidifying bulk liquid and ensures nuclei "survival" (i.e., the nuclei do not remelt into the metal liquor). The nuclei are dispersed throughout the bulk liquid by convective currents, where they can act as further nucleation sites and contribute to a homogeneously thixotropic microstructure. When very high numbers of nuclei are formed and prevented from remelting, the growth in size of the individual particle is limited, since there is a lack of space available for the particles to grow into. Moreover by limiting growth, this allows the initial morphologies of the nuclei to remain unaffected; therefore enough of the nuclei initially grow spherically and overall dendritic growth is suppressed throughout the alloy.

Generally, this invention includes a method for forming an alloy substantially free of dendrites. For example, this invention includes a method for forming a semi-solid slurry or a metal suitable for processing in an application that requires semi-solid slurries. Such a slurry can be used as a feed material for applications that require a supply of a semi-solid slurry (e.g., a rheocasting application) or be formed into billets for later use (e.g., in a thixocasting application).

In one embodiment, the method comprises the steps of cooling a superheated alloy to form a nucleated alloy, wherein the nucleated alloy includes a plurality of nuclei substantially free of entrapped liquid; controlling the temperature of the nucleated alloy to prevent the nuclei from melting; mixing the nucleated alloy to distribute the nuclei throughout; and cooling the nucleated alloy with nuclei distributed throughout, thereby forming an alloy substantially free of dendrites.

Initially, the materials comprising the superheated alloy are heated to a temperature sufficient to liquefy all of the constituent components of the alloy. Examples of suitable temperatures include 5° C., 10° C., 15° C., 25° C., 35° C., 45° C., 50° C., or more than 50° C. above the temperature at which the materials that make up the alloy are entirely liquid.

In some embodiments, the superheated alloy includes two or more materials used to make metallic items. For example, the superheated alloy can comprise mixtures that include aluminum, lead, tin, magnesium, manganese, strontium, titanium, silicon, iron, carbon, copper, gold, silver, and zinc. In further embodiments, the superheated alloy includes grain refiners, such as borides of titanium (e.g., $TiB_2$), borides of aluminum (e.g., $AlB_2$), TiC, and $Al_3Ti$.

In some embodiments, one or more of the individual components that are to make up the superheated alloy are heated separately. For example, if the superheated alloy is to comprise aluminum and titanium, the aluminum and titanium can be liquefied or partially liquefied before they are mixed together to form the superheated alloy. In yet more embodiments, the individual components of the superheated alloy are heated to different temperatures before they are mixed. For instance in the previous example, the titanium can be heated to a dissimilar temperature as the aluminum before the two are mixed to form the superheated alloy.

The superheated alloy is cooled to form a nucleated alloy, wherein the nucleated alloy includes a plurality of nuclei substantially free of entrapped liquid. Preferably, the temperature is sufficiently low so as to provide for the copious formation of nuclei, yet sufficiently high that the formation of dendrites is substantially prevented. The temperature that accomplishes this varies with the composition of the alloy and the demands of the given application. In some embodiments, the nucleated alloy is formed by reducing the temperature of the superheated alloy to the liquidus temperature or slightly below the liquidus temperature. For example, the superheated alloy may be cooled to 1° C., 2° C., 3° C., 4° C., 5° C., 7° C., 9° C., 10° C., or more than 10° C. below the liquidus temperature. In other embodiments, during this nuclei-forming stage, the nucleated alloy comprises a solids volume fraction of about 1% or less.

The temperature of the nucleated alloy is controlled to prevent the nuclei from melting, and the nucleated alloy is mixed to distribute the nuclei throughout the alloy. The temperature control scheme used to prevent the nuclei from melting varies depending on the composition of the alloy and the demands of the given application. In some embodiments, controlling the temperature to prevent the nuclei from melting entails maintaining the nucleated alloy at the same temperature to which the superheated alloy was initially cooled to provide for the copious formation of nuclei. In other embodiments, controlling the temperature entails continuously cooling the nucleated alloy at some predetermined rate and/or in a predetermined manner.

While cooling, the nucleated alloy is mixed in order to distribute the nuclei throughout the alloy. The distributed nuclei act as further nucleation sites and contribute to a homogeneously thixotropic microstructure. In some embodiments, the nucleated alloy is mixed by a passive mixer or by directing it through a tortuous flow path that induces convection and/or turbulence in the nucleated alloy.

The temperature of the nucleated alloy with nuclei distributed throughout is reduced to form an alloy substantially free of dendrites. The cooling rate of the nucleated alloy with nuclei distributed throughout and temperature to which it is cooled depends on the composition of the alloy and the demands of the given application. For example, some applications may require the alloy to be cooled at a rate of at least 5° C. per second. In other embodiments, the cooling rate is at least 15° C. per second. Other applications may require the alloy to be cooled at a rate of between about 20° C. per second and about 30° C. per second. In some embodiments, during this stage of nuclei growth, the nucleated alloy attains a solids volume fraction of at least about 30%. In yet more embodiments, the nucleated alloy attains a solids volume fraction in the range of about 40% to about 60%.

In some embodiments, the temperature of the alloy substantially free of dendrites is above the solidus line and the alloy is in the form of a slurry. In such embodiments, the alloy substantially free of dendrites can be directed to a metal forming process (e.g., a reheocasting application) where it is further formed and cooled to make a metal component. In other embodiments, the temperature of the alloy substantially free of dendrites is lowered below the solidus line prior to use in a metal forming process. For example in some embodiments, the nucleated alloy is poured into a form for a metal billet that is used as a specialty feedstock for future processing procedures (e.g., a thixocasting application) and cooled (e.g., by quenching with a cooler material).

In some embodiments, the alloy substantially free of dendrites possesses a primary particle size of about 100 microns or less. In other embodiments, the alloy substantially free of dendrites has a primary particle size in the range of between about 50 microns and about 100 microns when fully solid. In yet further embodiments, the alloy substantially free of dendrites has a primary particle size in the range of between about 30 microns and about 70 microns when the alloy is a slurry with a solid fraction of about 50%. In some embodiments, the alloy substantially free of dendrites possesses an average shape factor of at least 0.5. In other embodiments, the alloy substantially free of dendrites possesses an average shape factor in the range of between about 0.75 and about 0.95.

In some embodiments, this invention includes a continuous process for forming an alloy substantially free of dendrites, comprising the steps of directing a superheated alloy stream into a reactor, wherein the superheated alloy stream is continuously cooled and mixed to form a nucleated alloy stream, wherein the nucleated alloy stream includes a plurality of nuclei, wherein essentially all of said nuclei are substantially free of entrapped liquid distributed throughout; and continuously controlling the temperature of the nucleated alloy stream to prevent the nuclei from melting and continuously mixing the nucleated alloy stream to distribute the nuclei throughout, thereby continuously forming an alloy substantially free of dendrites.

In yet another embodiment, this invention includes a method for forming an alloy substantially free of dendrites, comprising the steps of cooling a superheated alloy to form a nucleated alloy, wherein the nucleated alloy includes a plurality of nuclei substantially free of entrapped liquid; controlling the temperature of the nucleated alloy to prevent the nuclei from melting and passively mixing the nucleated alloy to distribute the nuclei throughout; and cooling the nucleated alloy with nuclei distributed throughout, thereby forming an alloy substantially free of dendrites.

In a further embodiment, this invention includes a method for forming an alloy substantially free of dendrites, comprising the steps of superheating a first metal; superheating a second metal; mixing the first and second metals to form a superheated alloy; cooling the superheated alloy to form a plurality of nuclei substantially free of entrapped liquid; mixing the superheated alloy to distribute the plurality of nuclei throughout the superheated alloy; controlling the temperature of the superheated alloy to prevent the nuclei from remelting; and cooling the superheated alloy while the nuclei are distributed throughout, thereby forming an alloy substantially free of dendrites.

FIG. 1 is a schematic of apparatus 10, which can produce alloy 12. Alloy 12 is an alloy substantially free of dendrites. Two metals 14, 16 are heated separately until they attain a superheated liquid state in melting furnaces 18, 20, respectively. After metals 14, 16 have attained the desired temperature, they are directed from melting furnaces 18, 20 through runners 22, 24 and into reactor 26. Optionally, runners 22, 24 include heaters to mitigate heat loss from metals 14, 16 en route to reactor 26.

The two flows of metal 14, 16 mix within reactor 26, leaving as alloy 12, which is collected in crucible 28. Inside of reactor 26, the temperature of the combined flow of metals 14, 16 is reduced to below the liquidus line in order to induce the formation of nuclei. The combined flow follows a "tortuous path" defined by reactor 26. The tortuous path induces forced convection and/or turbulence in the metal flow, which distributes the nuclei throughout the flow.

In some embodiments, the reactor is heated or cooled to vary the rate of heat extraction. In other embodiments, the reactor includes a heating means (e.g., a heating element) and/or cooling means (e.g., a chiller or cooling stream). The heating and cooling means provide for increasing or decreasing the rate of heat loss from the flow to reactor 26. By removing or slowing the rate of heat loss from the flow, the rate of nucleation in the flow and/or the resulting volume fraction of solids in alloy 12 is manipulated.

Apparatus 10 can be incorporated into either a thixocasting or rheocasting application. For example, in one rheocasting embodiment, alloy 12 is directed into a molding die while the temperature of alloy 12 is still above the solidus line. Once in the die, alloy 12 is cooled to form a metal component. In a thixocasting embodiment, alloy 12 is formed into a billet for latter use in a semi-solid metal forming application.

In still further embodiments, this invention includes an alloy substantially free of dendrites formed by a method comprising the steps of cooling a superheated alloy to form a nucleated alloy, wherein the nucleated alloy includes a plurality of nuclei substantially free of entrapped liquid; controlling the temperature of the nucleated alloy to prevent the nuclei from melting; mixing the nucleated alloy to distribute the nuclei throughout; and cooling the nucleated alloy with nuclei distributed throughout, thereby forming an alloy substantially free of dendrites.

EXPERIMENTAL SETUP

A liquid mixing apparatus was constructed in a manner similar to the schematic of FIG. 1 to perform various experiments relevant to this invention. Two melting furnaces were formed from two ~15.24 cm in diameter and ~30.48 cm high (~6 inches in diameter and ~12 inches high) resistance tube furnaces were placed in sheet steel housings and insulated. Within each of these furnaces, a crucible-holding setup was constructed. The crucible-holding setup included two top and bottom steel rings connected to two threaded rods that ran vertically through the furnaces. These rods connect to a beam above the furnaces, and were anchored to ~10.16 cm diameter (~4 inches) ring plates that were in contact with the bottoms of the furnaces. The steel rings clamped the crucible in place, and the rods were put in tension so that the crucibles did not contact the furnace element.

The bottoms of the clay-graphite crucibles included threaded ~2.54 cm (~1 inch) holes. A "spout" component was screwed into the holes and extended about an inch from the bottom of the crucible. The exit hole through which the superheated metal flowed was ~1.27 cm (~0.5 inches) diameter. About a ~1.27 cm (~0.5 inches) diameter stopper rod was used to plug the hole during melting and temperature stabilization of the metal feeds. The rod and the spout were both made from hot-pressed boron nitride (BN).

The stopper rods were connected to two pull-action solenoids that were connected to the overhead beam. Both of the solenoids were wired to a toggle switch so that when the switch was thrown, the plugs were pulled from the exit spout allowing the liquid metal to flow from the exit holes of each crucible at the same time. Since each crucible was in a separate furnace, the temperatures of each feed metal could be independently controlled and monitored so that the heat contents of the melts upon mixing were precisely known.

The space beneath the melting furnaces was comprised of heated runners that transported the melt streams to the reactor. These runners were ~2.54 cm (~1 inch) diameter steel conduit tubes with a straightaway length of ~38.1 cm (~15 inches) and an angled length of ~10.16 cm (~4 inches). Several coats of insulating BN coating were applied to the insides of the tubes. In order to prevent heat loss from the flowing melts during transport, the runners were heated to ten degrees above the temperatures of the melts using coiled heating elements. These elements ensured a uniform temperature distribution along the entire lengths of the runners. Insulation was wrapped tightly around the tubes prior to an experiment and the temperature was controlled using a thermocouple placed in direct contact with the tube. It was experimentally determined that no heat was lost through the runners during the various experiments.

At the entrance of the reactor, a steel "boot" component was placed around the tubes in order to change the angle and diameter of incoming liquid to match that of the reactor passages and to prevent welding of the metal flows to the entrance bays of the reactor. The boot was coated with BN and placed in contact with the tube heaters in order to prevent premature solidification of the melts.

Figure 2:
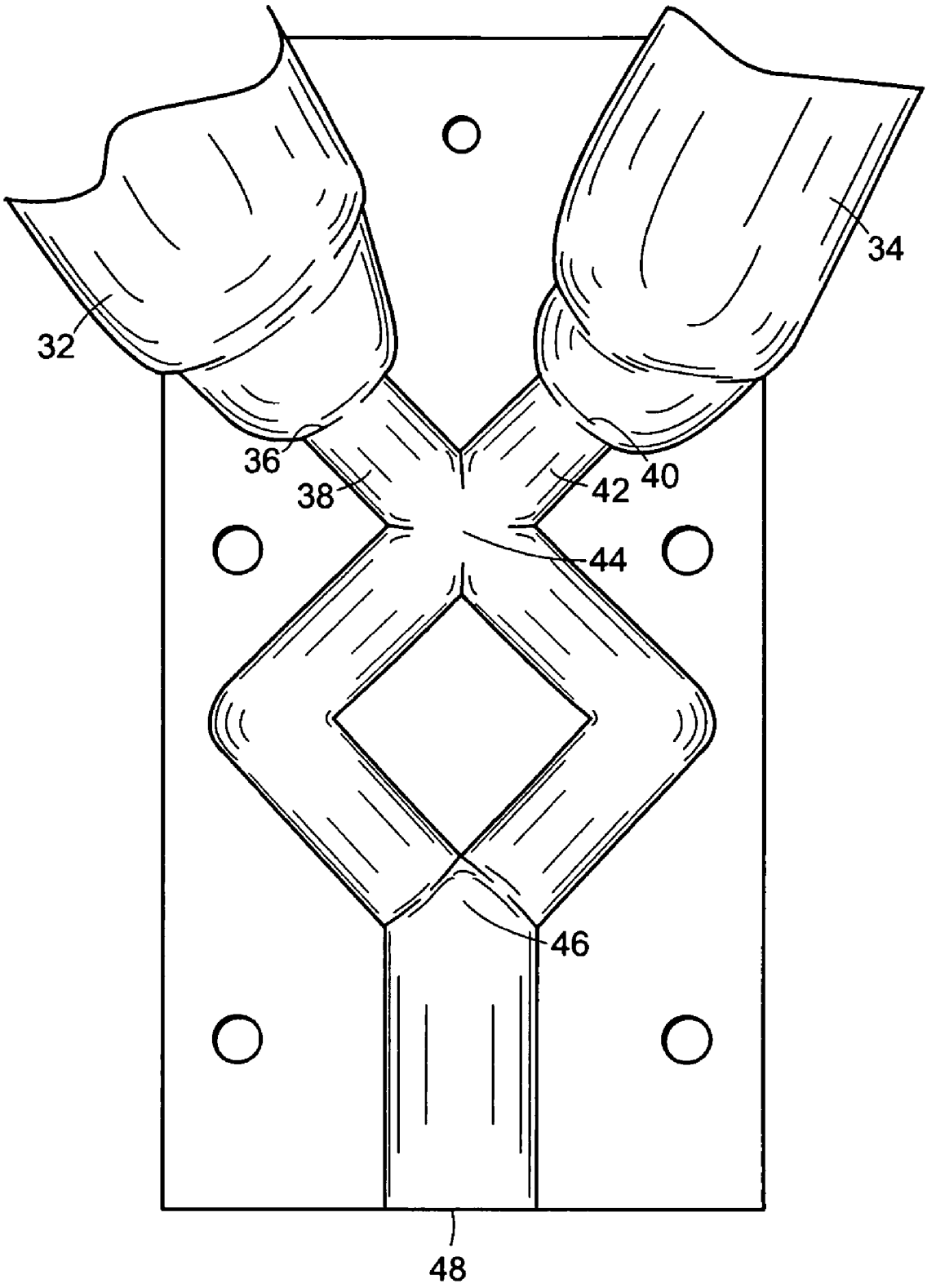
FIG. 2 is a side-view of a reactor portion of the liquid mixing apparatus constructed to perform various experiments relevant to this invention.

The reactor used during the various experiments was machined from a square copper block, ~7.62 cm (~3 inches) square and ~15.24 cm (~6 inches) in height. The diameter of the inner channels was ~1.27 cm (~0.5 inches). FIG. 2 shows a cut-away view of the reactor. Reactor 26 includes first melt inlet 32 and second melt inlet 34 for receiving one or more liquid melts. First melt inlet 32 has first exit 36, which connects to first channel 38. Second melt inlet 34 has second exit 40, which connects to second channel 42. First channel 38 and second channel 42 intersect at point 44 to allow liquid melts to mix with each other. First channel 38 and second channel 42 separate and later intersect again farther down stream at second point 46 to combine and mix in exit conduit 46. The melts in each channel exit reactor 30 through conduit 48 to enter, for example, a crucible.

It was important to ensure that the reactor would produce sufficient convection to effectively mix the melt streams. Therefore, a similitude experiment was carried out in which two water streams containing different colored dyes were mixed within the reactors. A transparent plastic was placed over the face of the reactor and the experiment was recorded with a video camera. It was determined that adequate mixing took place within the reactor and that metal melts flowing through the reactor would experience forced convection due to interaction between the two liquid streams.

As seen in FIG. 2, the copper block of the reactor was split in half along the vertical direction. The inner machining was done using a computer-guided end mill. Holes were tapped in the two faces so that the two halves of each block could be clamped together with hexagonal screws. The inner face of the reactor was coated with graphite spray to improve melt flow. Four small thermocouple holes were also endmilled at various points of the mixing channel in order to record the temperatures of the flowing melt streams at various points of the process. Finally, two support arms were constructed to connect to the top of the reactor, allowing for the reactor to be placed within a third preheating furnace. When the third preheating furnace was not used, the reactor sat on two parallel beams, set at an appropriate height to connect to the transport tubes. The receiving crucible was placed as close to the exit of the reactor as possible to minimize turbulence in the product slurry as it filled the receptacle.

Three alloys were used throughout the various experiments: A356.2 (with no grain refiners; hereafter referred to as "NGR"), A356.2 (with $TiB_2$ grain refiners; hereafter referred to as "GR"), and SiBloy® (Elkem Aluminium ANS, Oslo, Norway) which contains permanent grain refiners in the form of $AlB_2$ particles. Table 1 gives the chemical compositions (in wt %) and liquidus temperatures ($T_L$ in ° C.) of each of these alloys. Chemical compositions were obtained with a spectrographic analysis machine. Liquidus temperatures were determined with the derivative method on data collected in cooling experiments using calibrated thermocouples.

TABLE 1

| | $T_L$ | Si | Fe | Mn | Mg | Ti | Sr | V | B | Al |
|---|---|---|---|---|---|---|---|---|---|---|
| NGR | 616.2 | 6.82 | 0.07 | 0 | 0.324 | <0.002 | <0.001 | 0.006 | 0.001 | Balance |
| GR | 615.5 | 6.87 | 0.06 | 0 | 0.36 | 0.11 | <0.001 | 0.008 | 0.0005 | Balance |
| SiBloy ® | 616.0 | 6.83 | 0.08 | 0.02 | 0.291 | 0.003 | 0 | 0.001 | 0.016 | Balance |

NGR had a negligible Ti content, and thus was absent of grain refinement. The GR alloy included $TiB_2$ ("TiBor") grain refiners. SiBloy® is a permanently grain refined alloy containing $AlB_2$ particles in the molten state.

EXAMPLE 1

Thixocasting Experiments T1

Thixocasting processes were simulated in a series of experiments. The slurry was solidified in air within a clay-graphite crucible, after which small samples were reheated into the semi-solid metal range and quenched.

Heat transfer conditions in the reactor were affected by varying two parameters: melt superheat and reactor temperature. In the first set of thixocasting experiments (denoted "T1"), the superheats of the precursor melts were varied from 1-64° C. in order to gauge the heat extraction capability of the reactor. The reactor was kept at room temperature. Table 2 lists these experiments. "$T_{IN}$" refers to the temperature of each melt prior to mixing.

TABLE 2

| Exp. | $T_{IN}$ (° C.) | Mass/melt (g) | Alloy | $T_{reactor}$ (° C.) |
|---|---|---|---|---|
| T1-1 | 617 | 300 | NGR | room temp. |
| T1-2 | 625 | 300 | NGR | room temp. |
| T1-3 | 640 | 300 | NGR | room temp. |
| T1-4 | 660 | 300 | NGR | room temp. |
| T1-5 | 680 | 300 | NGR | room temp. |

Figure 3A:
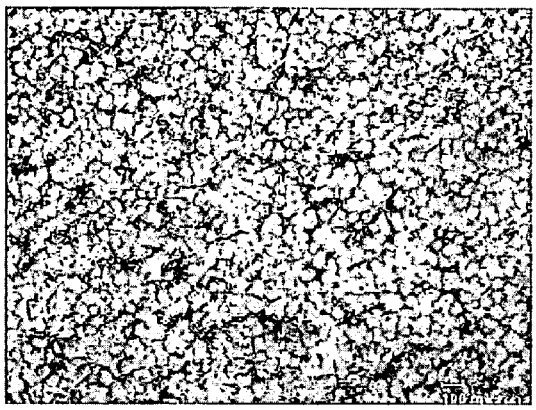
FIGS. 3A and 3B exhibit micrographs from the T1-2 experiment.
Figure 3B:
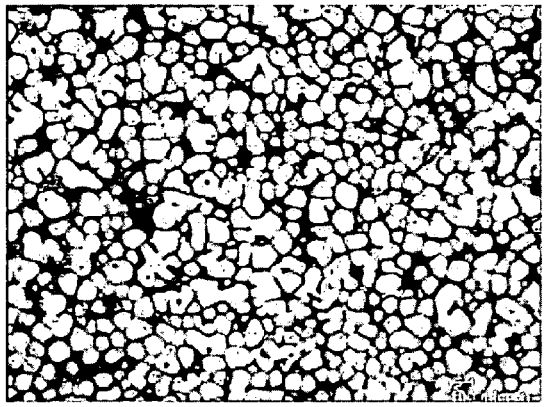
Figure 4A:
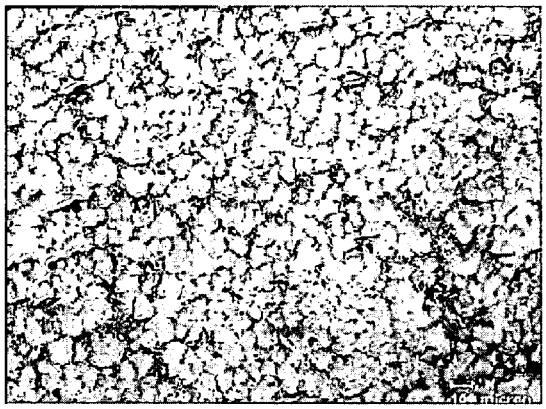
FIGS. 4A and 4B exhibit micrographs from the T1-3 experiment.
Figure 4B:
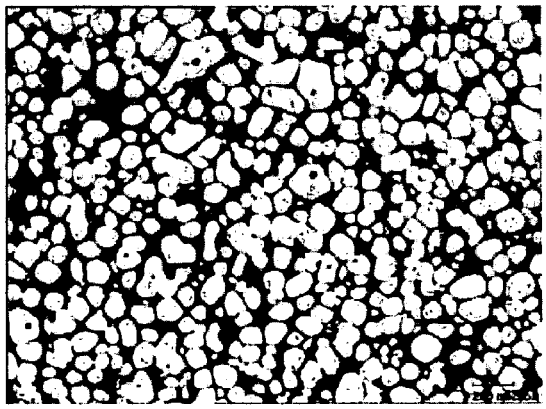
Figure 5A:
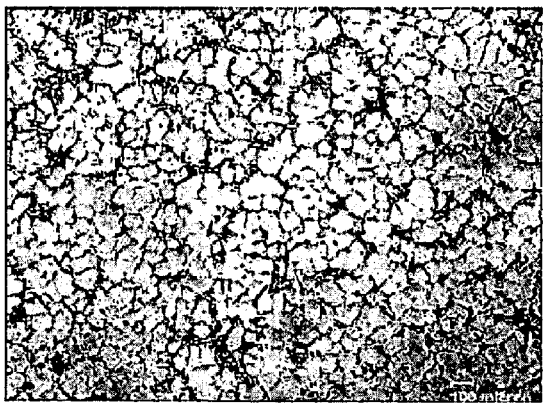
FIGS. 5A and 5B exhibit micrographs from the T1-4 experiment.
Figure 5B:
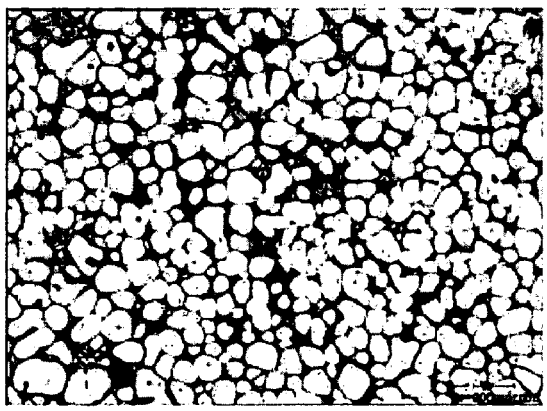

FIGS. 3A, 3B, 4A, 4B, 5A, and 5B exhibit the representative micrographs from the T1-2, T1-3, and T1-4 experiments, respectively. The as-solidified micrographs are shown as FIGS. 3A, 4A, and 5A, while the micrographs on FIGS. 3B, 4B, and 5B show the microstructure obtained after reheating to 585° C. and holding for 10 minutes, followed by immediate quenching in water. The microstructures in FIG. 3B had a residence time of reheated slug in semi-solid metal range of about 38 minutes. The microstructures in FIG. 4B had a residence time of reheated slug in semi-solid metal range of about 25 minutes. The microstructures in FIG. 5B had a residence time of reheated slug in semi-solid metal range of about 18 minutes.

FIGS. 3-5 show the effect of raising the superheat of the precursor melts on the resultant microstructures. Each of the above microstructures is highly refined compared to typical as-received ingots. The reheated samples show globular α-Al particles distributed in a liquid matrix, with very little entrapped liquid. It is clear that the entrapped liquid in these samples results from coarsening of irregular (i.e. semi-dendritic) particles during reheating. Most of the particles have a spherical morphology, but small portions of them are irregular in shape. Irregularly shaped particles are likely related to dendritic growth within the reactor. Although to a limited extent, small dendrites inevitably grow in parts of the flowing liquid and collisions of these particles may account for the observed shapes. Also evident in the micrographs is an appreciable level of particle agglomeration, which is common characteristic of the structures obtained with the current reactor. It is believed this is a combination of the collisions undergone as the melts flow through the reactor, and grain coalescence during reheating.

TABLE 3

| Experiment | Avg. Particle Diameter, As-solidified (μm) | Avg. Particle Diameter, reheated (μm) | Avg. Shape Factor, reheated | Number of particles analyzed |
|---|---|---|---|---|
| T1-2 | 65.2 | 92.1 | 0.86 | 547 |
| T1-3 | 76.7 | 96.8 | 0.88 | 409 |
| T1-4 | 90.1 | 101.2 | 0.87 | 378 |

Table 3 summarizes the image analysis results for the micrographs of FIGS. 3A, 3B, 4A, 4B, 5A, and 5B. Increasing the superheat clearly results in larger particle size in both the as-solidified and reheated samples. Shape factor data show that increasing superheat does not affect the morphologies of the analyzed particles. Shape factor was determined from the relationship:

$$\text{Shape Factor}=(4\pi*\text{Area})/\text{Perimeter}^2$$

A shape factor value of one corresponds to a perfectly spherical particle, whereas values close to zero indicate dendrites or very irregularly shaped particles. In the reheated samples (and slurry samples shown later), only the more spherical particles were analyzed in order to avoid confusion arising from numerical contributions of irregular particles. This was achieved by defining a classification scheme in the analysis program in which particles with very low shape factor values were excluded. Finally, the number of particles analyzed gives an indirect quantification of the degree of particle irregularity in the samples. Although the micrographs chosen may not portray the exact fraction of irregular particles in the entire sample, it is noteworthy that this value decreases for increasing superheat.

In FIG. 3B, the most uniform as-solidified structure is observed, with the highest level of grain refinement and non-dendritic morphology. FIG. 4B exhibits a similar microstructure, but with a larger average particle diameter. There is still a high amount of non-dendritic particles, but a well-globularized semi-solid metal structure is obtained upon reheating. FIG. 4B has the largest particle size, and shows the highest number of irregular particles. Even at this high superheat, the particles are for the most part non-dendritic. Despite the higher fraction of irregular particles, the reheated structure indicates a predominantly globular morphology. This is probably due to the long residence times of the reheated samples in the SSM range (due to the long time is took for the sample to reach 585° C.). Longer residence times lead to coarsening of the particles; therefore initially irregular particles may become more spherical due to the driving force for these particles to reduce surface area. This also explains why for each experiment the particles in the reheated samples are larger than in the as-solidified ones.

It is concluded from the T1 experiments that globular structures can be obtained by mixing alloy melts having relatively high superheats. This indicates that the reactor is able to extract very large amounts of heat in a small amount of time. Therefore it is not necessary to have a precursor liquid very close to the liquidus temperature in order to obtain thixotropic structures with the processes of this invention. Finally in both the as-solidified and reheated samples, there is a clear trend of (a) increasing particle size for increasing superheat and (b) increasing level of particle irregularity (or tendency to grow dendritically to small degrees) for increasing superheat.

EXAMPLE 2

Thixocasting Experiments T2

In a second set of thixocasting experiments (denoted "T2"), three superheats and three reactor temperatures were chosen to observe the effects of different heat transfer conditions on the resultant structures. The reactor was placed within the third furnace, and four thermocouples were inserted into the thermocouple holes to monitor its temperature. An increase in reactor temperature decreased the heat extraction rate of the melts as they flowed through the reactor, thereby decreasing the nucleation rate of the combined melts. The receiving crucible was at ambient temperature upon collection of the slurry. A thermocouple placed in the exit channel recorded the slurry's exit temperature. Table 4 lists the experiments carried out with this configuration.

TABLE 4

| Exp. | $T_{MIX}$ (° C.) | $T_{reactor}$ (° C.) | Alloy | Mass/melt (g) |
|---|---|---|---|---|
| T2-1 | 625 | 130 | NGR | 300 |
| T2-2 | 625 | 315 | | 300 |
| T2-3 | 625 | 500 | | 300 |
| T2-4 | 640 | 130 | NGR | 300 |
| T2-5 | 640 | 315 | | 300 |
| T2-6 | 640 | 500 | | 300 |
| T2-7 | 655 | 130 | NGR | 300 |
| T2-8 | 655 | 315 | | 300 |

For T2-4 through T2-6, the superheat was kept the same while the temperature of the reactor was varied. T2-8 had the lowest heat extraction conditions, thus the temperature of the exiting slurry was above the liquidus.

The temperature of the reactor was increased in order to decrease its heat extraction capability. The purpose was to vary the processing conditions to give a wide range of particle morphologies, as well as to establish relationships between the variables and the resultant microstructures. In doing so, the limits of the reactor's heat extraction capability were gauged. FIGS. 6A, 6B, 7A, 7B, 8A, 8B, 9A, and 9B show the micrograph results from some of the experiments listed above.

Figure 6A:
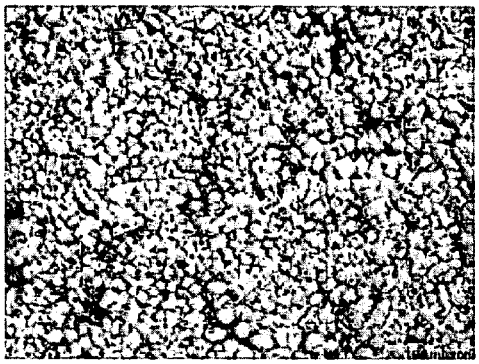
FIGS. 6A and 6B exhibit micrographs from the T2-4 experiment.
Figure 6B:
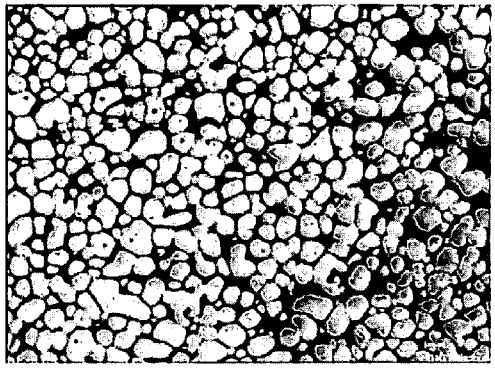
Figure 7A:
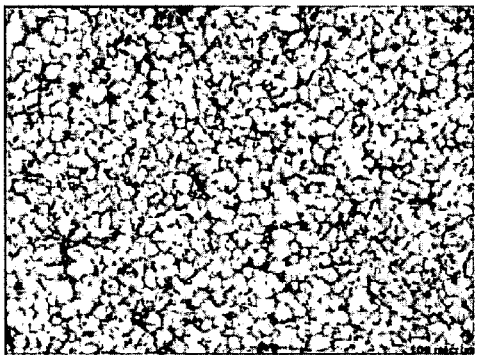
FIGS. 7A and 7B exhibit micrographs from the T2-5 experiment.
Figure 7B:
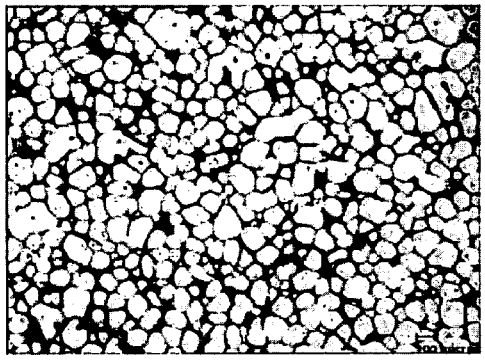
Figure 8A:
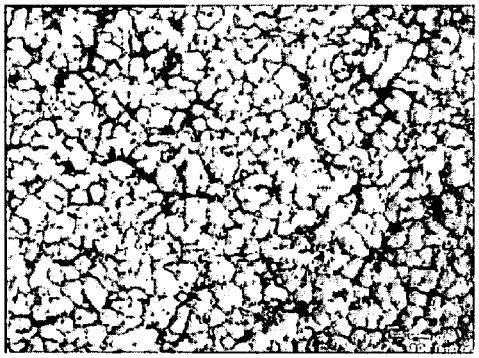
FIGS. 8A and 8B exhibit micrographs from the T2-6 experiment.
Figure 8B:
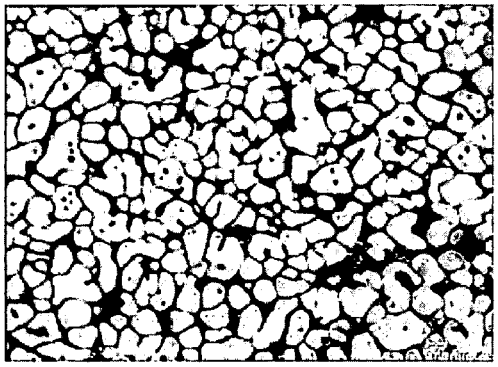
Figure 9A:
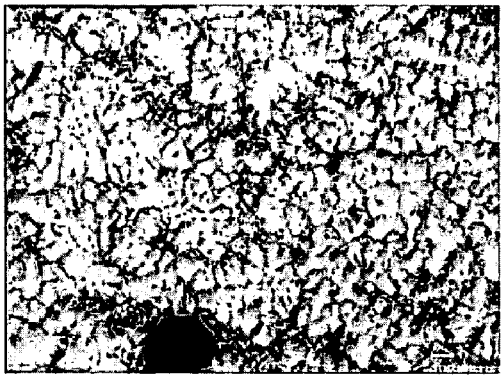
FIGS. 9A and 9B exhibit micrographs from the T2-8 experiment.
Figure 9B:
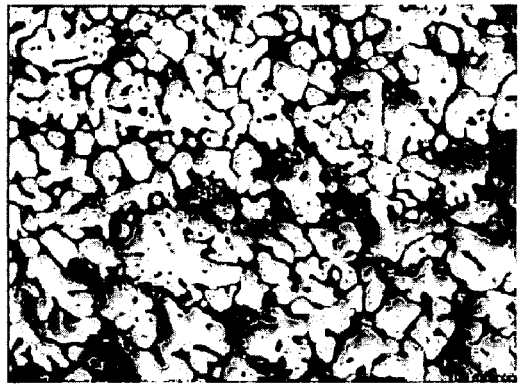

FIG. 6A shows the micrograph for the as-solidified structure of experiment T2-4, and FIG. 6B shows the reheated micrograph that had a 24-minute residence time in the SSM temperature range. FIG. 7A shows the micrograph for the as-solidified structure of experiment T2-5, and FIG. 7B shows the reheated micrograph that had a 25-minute residence time in the SSM temperature range. FIG. 8A shows the micrograph for the as-solidified structure of experiment T2-6, and FIG. 8B shows the reheated micrograph that had a 16-minute residence time in the SSM temperature range. FIG. 9A shows the micrograph for the as-solidified structure of experiment T2-8, and FIG. 9B shows the reheated micrograph that had a 2-minute residence time in the SSM temperature range.

The particle size in the as-solidified samples increases slightly from T2-4 to T25 due to the lower heat transfer within the reactor. In the reheated samples, it is observed that both experimental conditions lead to highly globular structures of similar particle size. FIG. 7B shows roughly the same number of irregular particles as shown in FIG. 6B, and the majority of both structures is globular. In these two experiments, the product slurry exited the reactor at a temperature just below the liquidus temperature of the alloy, resulting in a very low solid fraction, highly fluid slurry. This indicates that most of the particles seen in any given sample are formed at or just below the liquidus temperature; therefore it is only necessary to cool the liquid to one or two degrees below the liquidus temperature.

TABLE 5

| Experiment | Avg. Particle Diameter, As-solidified (μm) | Avg. Particle Diameter, reheated (μm) | Avg. Shape Factor, reheated | Number of particles analyzed |
|---|---|---|---|---|
| T2-4 | 67.6 | 96.8 | 0.89 | 393 |
| T2-5 | 76.8 | 98.5 | 0.9 | 387 |
| T2-6 | 105.3 | 116.7 | 0.71 | 235 |

Table 5 lists the image analysis results for the T2 experiments. As used herein, the term "average" in relation to shape factor values refers to the mean value taken from the entire data set of all particles analyzed by the classification scheme.

The micrographs show that particle shape irregularity reaches a maximum when the reactor temperature is highest. Numerically, shape factor values are about the same in T2-4 and T2-5, but change noticeably in experiment T2-6. Also, the number of particles analyzed drops in T2-6, which suggests that more irregular particles were excluded by the classification scheme. Moreover, in T2-6 the presence of non-spherical particles in both the as-solidified and reheated samples is more evident than in the previous experiments. The exiting slurry was just above the liquidus temperature of the alloy, therefore the thermal conditions of the reactor led to a lower level of nucleation. The decrease in nucleation rate led to a larger particle size in T2-6, since grain growth was promoted by the presence of fewer particles. On reheating, a significant amount of liquid was entrapped by the coarsening particles, as seen in FIG. 8B.

FIG. 9B reinforces the reasoning presented above concerning the requirement of a small solid fraction of the slurry upon exit. The exit temperature was 618° C., and these microstructures show the highest degree of dendritic growth. This is because the majority of nuclei formed within the receiving crucible rather than the reactor; therefore there was a lower cooling rate through the alloy's liquidus temperature. Upon reheating and quenching, the dendrites in the as-solidified structure coarsened, but did not approach the level of sphericity observed in the previous reheated samples.

It is concluded from the T2 experiments that the goal of forming a distinct range of particle morphologies was met by heating the reactor to various temperatures. Particle size increased and shape factor decreased when the reactor was hottest (providing less heat extraction), which suggests less effective heat extraction in the reactor. A higher reactor temperature led to more dendritic morphologies, whereas lower reactor temperatures produced spherical, thixotropic slurry structures. The extent to which the metal is cooled below its liquidus temperature dictates how globular the overall structure becomes.

EXAMPLE 3

Rheocasting Experiments R1

Rheocasting processes were simulated in another series of experiments. In these experiments, the slurry was collected and quenched into water at various temperatures within the two-phase range of the alloy. Three distinct methods of collecting the rheocast slurry were used in the rheocasting set of experiments. In the first method, slurry was quenched immediately into water without entering a crucible. In the second technique, a heated receiving crucible was employed from which small amounts of the slurry were removed at various times and quenched in water. In the third approach, the entire slurry crucible was quenched in water at a single temperature in the two-phase field. By changing the temperature of the receiving crucible, the cooling rates of the received slurry were varied.

Two experimental runs were conducted using the first method (denoted as "R1"). A large reservoir of cold water was used as a receptacle. This resulted in a very high cooling rate in the collected slurry. The experiment was conducted at a temperature of 625° C. All other conditions were identical to those in experiment T1-2 (see Table 3).

Figure 10A:
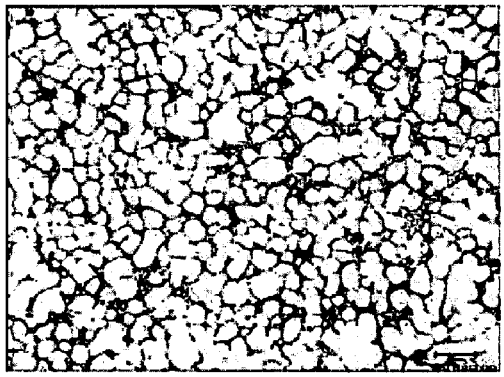
FIGS. 10A and 10B exhibit micrographs from the R1-1 experiment.
Figure 10B:
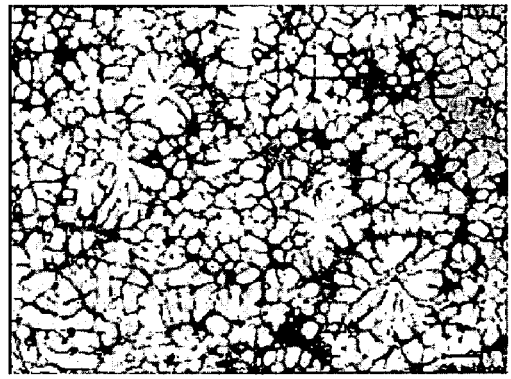

In the R1 experiments, the slurry went from the reactor's exit directly into the large volume of water. Therefore the sample was immediately quenched and the microstructure was frozen in place. In the experiment presented below, the temperature of the precursor melts was 625° C., giving a superheat of about 9° C. The reactor was at room temperature, as was the water used for quenching. The cooling rate and temperature of the slurry upon exit was not measured due to the experimental setup, but the conditions were the same as those in experiment T2-2. FIGS. 10A and 10B show two micrographs from this experiment.

Two micrographs for Experiment R1-1 are shown in FIGS. 10A and 10B and the observed microstructures are much different than those seen in the thixocasting experiments. The primary particles are a great deal smaller, which is to be expected since there is very little time allowed for growth. The fine structure of eutectic phase shows that the cooling rate during quenching was very fast. The smallest particle seen above is about 13.6 μm in diameter, and the largest one is about 34 μm. The average particle diameter is about 19.7 μm and the average shape factor is about 0.79. Also, there are many more irregularly shaped particles (as well as some rosettes) observed here than in the thixocasting experiments.

Two major factors contribute to the morphologies of Experiment R1-1. First, the higher heat transfer undergone within the water bath results in very little particle growth after nucleation. Secondly, the additional convection that is typically experienced by the slurry as it fills the receiving crucible is absent here. Since the slurry is highly fluid on exit, convection from crucible filling may contribute to breaking up of dendrites and spheroidization of the irregular particles. It should be noted that FIG. 10B is not representative of the entire sample; rather, the dendrites only formed in a particular section of the quenched sample. It is possible that the dendrites did not form in the reactor, but instead nucleated as the liquid phase was exposed to the air in the short distance between the reactor and the water.

When low solid fraction semi-solid slurry is quenched into water, it is expected that large amounts of eutectic be quenched from the liquid phase; therefore the density of the primary particles should be low. However the micrographs in FIGS. 10A and 10B dispute this expectation, since a large number of particles was present in the slurry as it exited the reactor. The solid fraction observed in the micrographs, which were from a slurry at ~610° C., are much higher than one would expect. This evidence suggests that additional nuclei form during the water quench, and then grow to a very small degree. These nuclei were most likely formed on particles that were present in the slurry as it exited the reactor.

It is concluded from these experiments that very fine-grained structures are obtained when the slurry is immediately quenched and not collected in a crucible. This finding directly shows that there is a very high density of nuclei in the exiting slurry, which further indicates that copious nucleation takes place in the reactor. Also, the convection/turbulence undergone by the slurry as it fills a receiving crucible may play a role in the mechanisms leading to SSM structure formation.

EXAMPLE 4

Rheocasting Experiments R2

The second method involved the direct collection of semi-solid slurry. Using the third furnace, the receiving crucible was preheated to various temperatures. After slurry collection, small amounts were scooped out from the receptacle and quenched in water. The reactor was kept at ambient temperature for each of these experiments. The first phase of these experiments, denoted "R2," is listed in Table 6.

TABLE 6

| Exp. | $T_{MIX}$ (° C.) | $T_{cruc}$ (° C.) | Alloy | Samples taken at (° C.) |
|---|---|---|---|---|
| R2-1 | 640 | 585 | GR | 597, 590, 585, 575, RT |
| R2-2 | 655 | 585 | GR | 605, 597, 590, 585, 575, RT |
| R2-3 | 625 | 585 | GR | 610, 605, 597, 590, 585, 575, RT |
| R2-4 | 670 | 585 | GR | 610, 597, 590, 585, 575, RT |
| R2-5 | 625 | 450 | GR | 610, 600, 590, RT |
| R2-6 | 625 | 450 | SiBloy ® | 610, 600, 590, 580, RT |
| R2-7 | 625 | 450 | NGR | 600, 590, 580, RT |

Since two different crucible temperatures (585° C. and 450° C.) were used in the experiments, different cooling rates of the slurry through the two-phase field resulted. In all experiments the mass of each charge was approximately 300 g.

In the first experiment, a very slow cooling rate though the SSM range occurred due to a high receiving crucible temperature. In the other three experiments, the cooling rate was higher, and was kept nearly constant. In these higher cooling rate experiments, the variable of grain refinement additions was also investigated. For each of these experiments, the reactor was kept at room temperature ("RT").

Figure 11A:
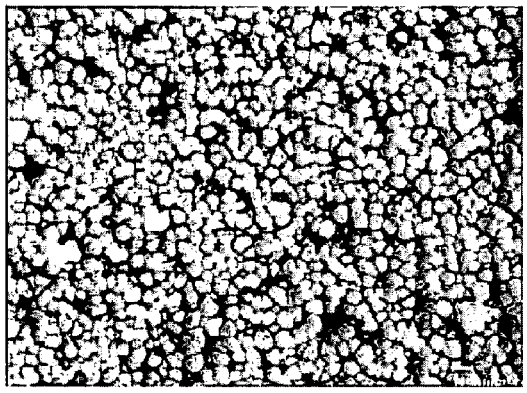
FIGS. 11A, 11B, 11C, and 11D exhibit micrographs from experiment R2-2.
Figure 11B:
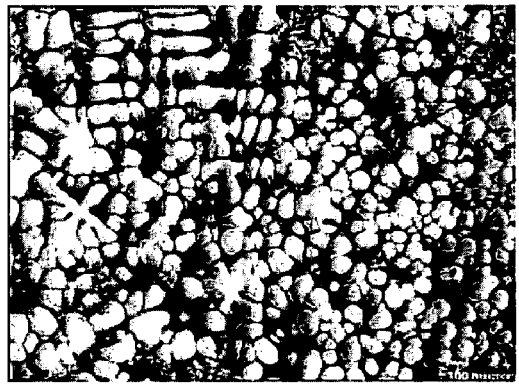
Figure 11C:
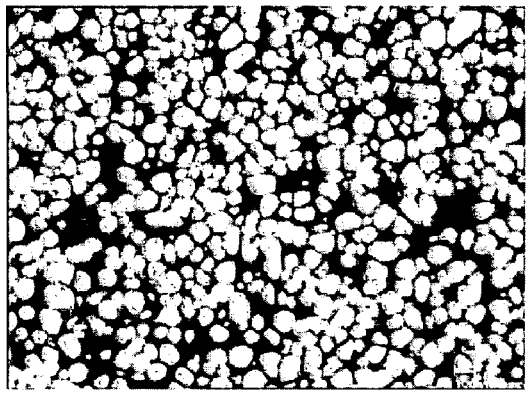
Figure 11D:
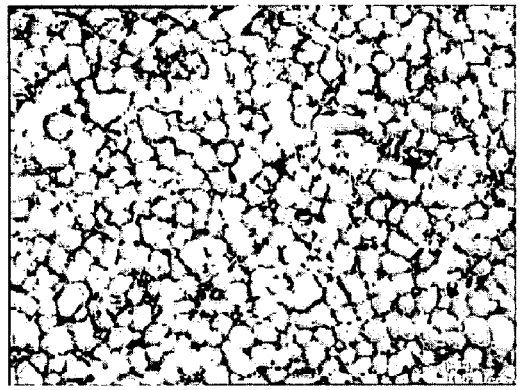

FIGS. 11A, 11B, 11C, and 11D show a collection of micrographs from experiment R2-2. The cooling rate for R2-2 was approximately −0.7°/sec. FIG. 11A is a micrograph of a sample taken at 4.2 minutes and 605°. FIG. 11B is a micrograph of a sample taken at 9.6 minutes and 597°. FIG. 11C is a micrograph of a sample taken at 14.5 minutes and 590°. FIG. 11D is a micrograph of a sample taken at room temperature.

The structures illustrated in FIGS. 11A, 11B, 11C, and 11D are superior to those obtained with the thixocasting method. Particle sizes are much smaller using this technique, and size distributions do not vary to an appreciable extent. The presence of dendrites in isolated regions of the samples is an interesting feature, but the majority of these structures are of a globular nature. These dendrites probably resulted from small volumes of liquid that were deposited into the receptacle just above the liquidus temperature. These results give direct evidence that the liquid mixing methods of this invention lead to highly globular semi-solid slurries of fine particle size. Upon entry of these slurries into the heated receptacle, a relatively large amount of time was spent in the SSM range due to the slow cooling rate resulting from a high receptacle temperature. Nonetheless, whatever amount of growth occurred did not result in a significant increase in particle size. The solid fractions suggested by FIGS. 11A, 11B, 11C, and 11D, however, are in contradiction with theoretical values. That is, one would expect to see more liquid phase at a temperature of 605° C. Table 7 summarizes the image analysis results for the samples of R2-2.

TABLE 7

| Slurry temperature (° C.) | Avg. Particle Diameter (μm) | Avg. Shape Factor | Number of particles analyzed |
|---|---|---|---|
| 605 | 68.8 | 0.83 | 745 |
| 597 | 84.2 | 0.82 | 377 |
| 590 | 85.7 | 0.87 | 459 |
| As-solidified (RT) | 103.2 | — | 87 |

It is concluded from these results that using a heated crucible and collecting slurry during its residence time in the SSM range observe even better refined thixotropic structures. The particle sizes are much smaller when compared to the reheated structures of the thixocasting experiments. As seen in Table 7, particle size gradually increases as the slurry is solidified. Average shape factor data do not vary appreciably.

FIGS. 12A, 12B, 12C, 13A, 13B, 13C, 14A, 14B, 14C, 15A, and 15B compare micrograph results from experiments R2-5, R2-6, and R2-7 which all had substantially higher cooling rates (~−0.22° C./sec, ~−0.23° C./sec, and ~−0.18° C./sec, respectively) than experiment R2-2. The purpose of these experiments was twofold: first, to compare the presence of two different kinds of grain refiners to the non-grain-refiner-containing A356.2 alloy; and secondly, to study the effect of a higher cooling rate through the semi-solid temperature range.

Figure 12A:
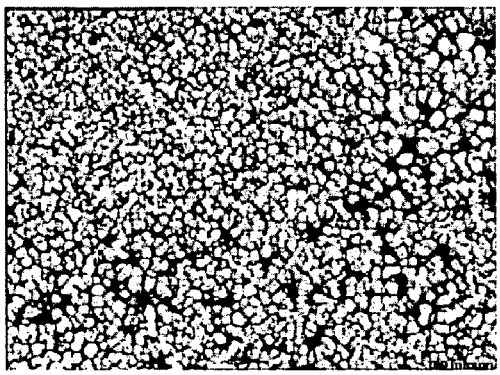
FIGS. 12A, 12B, and 12C exhibit micrographs from experiments R2-5, R2-6, and R2-7.
Figure 12B:
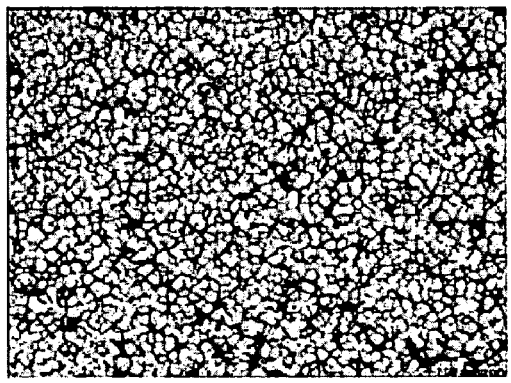
Figure 12C:
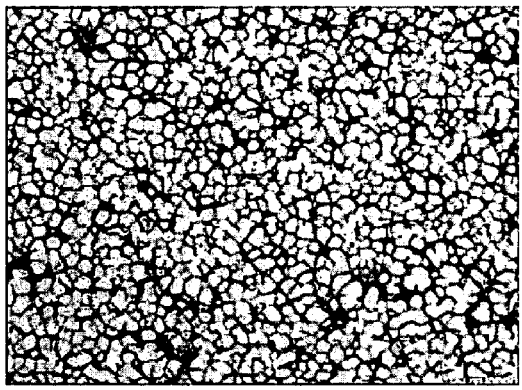
Figure 13A:
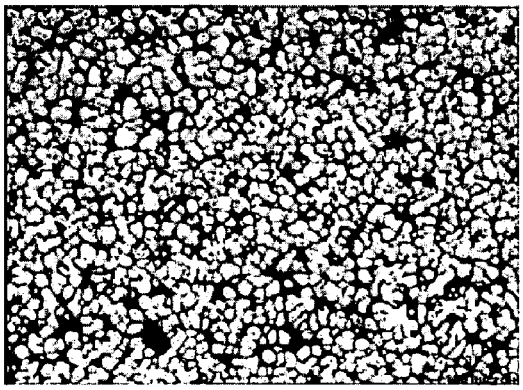
FIGS. 13A, 13B, and 13C exhibit micrographs from experiments R2-5, R2-6, and R2-7.
Figure 13B:
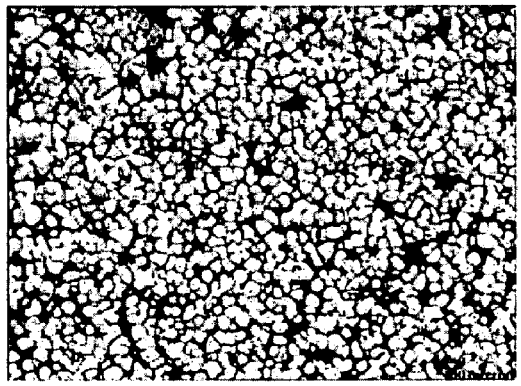
Figure 13C:
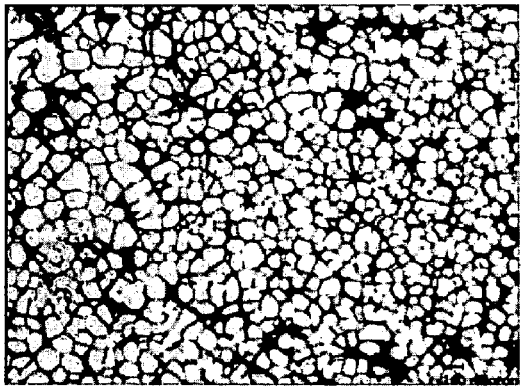
Figure 14A:
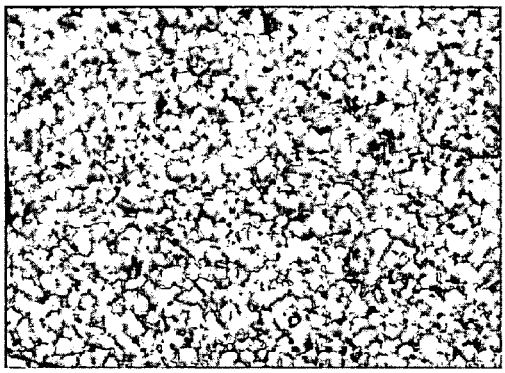
FIGS. 14A, 14B, and 14C exhibit micrographs from experiments R2-5, R2-6, and R2-7.
Figure 14B:
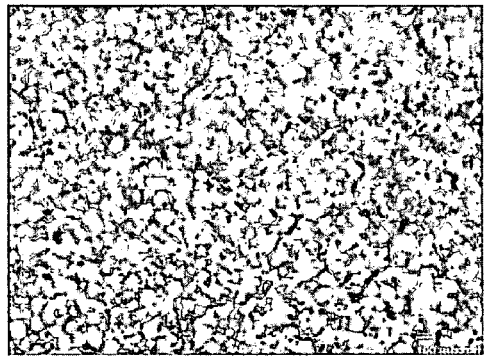
Figure 14C:
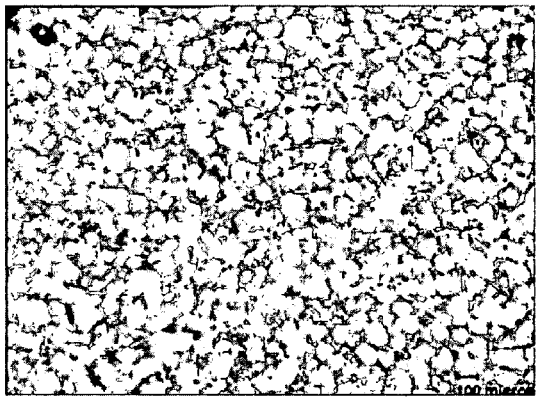

FIGS. 12A, 12B, 12C, 13A, 13B, 13C, 14A, 14B, and 14C show that the presence of grain refiners in an alloy only modifies the resultant structures to a small degree. FIG. 12A shows the micrograph of a sample from experiment R2-5 which was quenched at 600° C. and 1.8 minutes, 12B shows the micrograph of a sample from experiment R2-6 which was quenched at 600° C. and 2.0 minutes, and 12C shows the micrograph of a sample from experiment R2-7 which was quenched at 600° C. and 2.3 minutes. FIG. 13A shows the micrograph of a sample from experiment R2-5 which was quenched at 590° C. and 2.3 minutes, 13B shows the micrograph of a sample from experiment R2-6 which was quenched at 590° C. and 2.8 minutes, and 13C shows the micrograph of a sample from experiment R2-7 which was quenched at 590° C. and 2.3 minutes. FIG. 14A shows the micrograph of a sample from experiment R2-5 taken at room temperature, 14B shows the micrograph of a sample from experiment R2-6 taken at room temperature, and 14C shows the micrograph of a sample from experiment R2-7 taken at room temperature. "Quenching time" refers to the amount of time a metal stays in the two-phase range before quenching.

The two types of grain refiners used in the experiments both lead to a similar particle size. The micrographs also clearly indicate that when a non-grain refined alloy is used, the average particle size becomes slightly coarser; however, they still have highly refined structures in comparison to most commercial SSM processes. It should be noted that the cooling rate of the slurry after exiting the reactor in experiment R2-7 was slightly lower than in experiments R2-5 and R2-6, which may have contributed to this observed trend.

The structures shown in FIGS. 12A, 12B, 12C, 13A, 13B, 13C, 14A, 14B, and 14C indicate that the level of nucleation obtained with the reactor with no inoculants present is sufficient for the formation of equiaxed, non-dendritic structures. They also show that when inoculants are present prior to mixing within the reactor, even finer structures can be produced. Quantitative verification of these statements is presented in Table 8, which shows the general trend of increasing particle size in the three experiments.

TABLE 8

| Sample | Avg. Particle Diameter (μm) | Avg. Shape Factor | Number of particles analyzed |
|---|---|---|---|
| GR A356.2 - 600° C. | 41.4 | 0.88 | 446 |
| GR A356.2 - 590° C. | 55.3 | 0.88 | 127 |
| GR A356.2 - As-solidified | 66.4 | — | 203 |
| GR SiBloy - 600° C. | 47.6 | 0.86 | 305 |
| GR SiBloy - 590° C. | 54.2 | 0.88 | 241 |
| GR SiBloy - As-solidified | 65.9 | — | 231 |
| NGR A356.2 - 600° C. | 60.5 | 0.88 | 561 |
| NGR A356.2 - 590° C. | 67.9 | 0.9 | 458 |
| NGR A356.2 - As-solidified | 81 | — | 167 |

When comparing the above results to those shown in Table 7, it becomes clear that the increased cooling rate led to a much finer particle size than in experiment R2-2. Values for shape factor are about the same in all four runs.

Figure 15A:
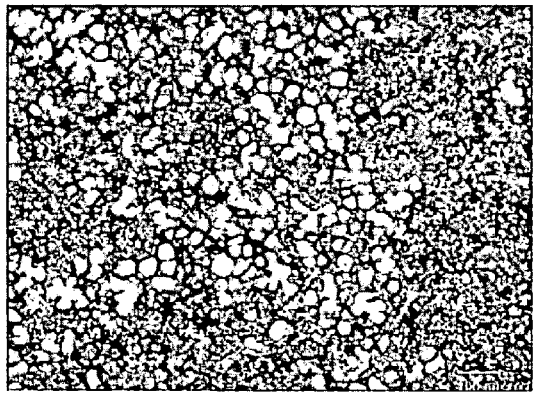
FIGS. 15A and 15B exhibit micrographs from experiment R2-5.
Figure 15B:
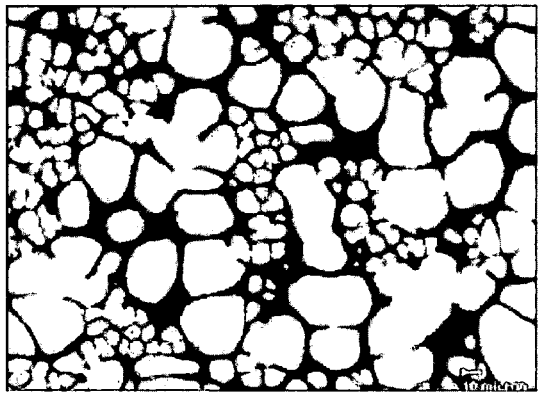

FIGS. 15A and 15B show two additional microstructures from a sample taken during experiment R2-5. This sample was quenched at 610° C. (~50 seconds after collection), corresponding to a low solid fraction. FIG. 15A is at 50× magnification, while 16(*b*) is at 200× magnification. FIGS. 15A and 15B indicate that more nucleation events occur during the slurry quenching technique. Image analysis results of these micrographs are shown below in Table 9. The very small particles nucleated as the scooping utensil (thimble) was used to transfer the sample from the crucible to the water. These nucleation events were likely facilitated by the presence of $TiB_2$ inoculants in the liquid phase of the slurry. Therefore, if this additional nucleation event had not occurred, then the structures would be comprised of the larger particles seen above, combined with quenched eutectic in the regions where the smaller particles are observed. This structure would better reflect the low solid fraction of the slurry at this temperature. The higher magnification micrograph of FIG. 15B shows that these secondary α-Al particles nucleate on the previously formed particles.

TABLE 9

| Sample | Avg. Particle Diameter (μm) | Avg. Shape Factor | Number of particles analyzed |
|---|---|---|---|
| R2-5 - 610° C. | Large particles (primary nucleation event): 36.1<br>Small particles (secondary nucleation event): 10.5 | 0.85 | 150 |

It is concluded from these experiments that a higher cooling rate through the two-phase range leads to more refined SSM structures. Also, it is clear that the presence of grain refiners in the alloys used does not significantly affect the particle size and shape of the structures; that is, nucleation rate is not enhanced to an appreciable extent when inoculants are present. The level of equiaxed, non-dendritic growth observed in non-grain-refined A356.2 is high enough to conclude that the reactor design is the major contributor to the observed structures.

EXAMPLE 5

Rheocasting Experiments R3

In an alternative approach, different preheat temperatures in the receiving crucible were used to attain different cooling rates of the product slurry through the two-phase region. Furthermore, the entire slurry crucible was quenched in a large volume of water at a single temperature in the SSM range, rather than removing small amounts at iterated times. This gave a more accurate sense of the temperature of the sample upon quenching. The volume of slurry quenched here is much larger than the volumes of "slugs" reheated in the thixocasting experimental set. Two variables were explored in these experiments. First, the effect of a higher cooling rate than the ones in the R2 experiments was investigated. Secondly, instead of using two separate melts, in experiment R3-4 only one melt was used, in order to compare forced convection levels. These experiments, denoted "R3," are summarized in Table 5.

TABLE 10

| Exp. | $T_{MIX}$ (° C.) | $T_{crucible}$ (° C.) | Alloy | Mass/melt (g) | Sample(s) taken at (° C.) |
|---|---|---|---|---|---|
| R3-1 | 625 | 100 | GR | 300 | 588 |
| R3-2 | 625 | 200 | GR | 300 | 585 |
| R3-3 | 620 | 200 | GR | 300 | 585 |
| R3-4* | 625 | 500 | GR | 300 | 585 |
| R3-5 | 625 | 500 | GR | 300 | 585 |

As seen in Table 10, the main variable was the receiving crucible temperature, which led to different cooling rates of the slurry through the two-phase field. R3-4 is marked with an asterisk because only one melt was used in order to observe the theoretical effect of less convection (due to less liquid mixing) on the resultant structures.

Figure 16A:
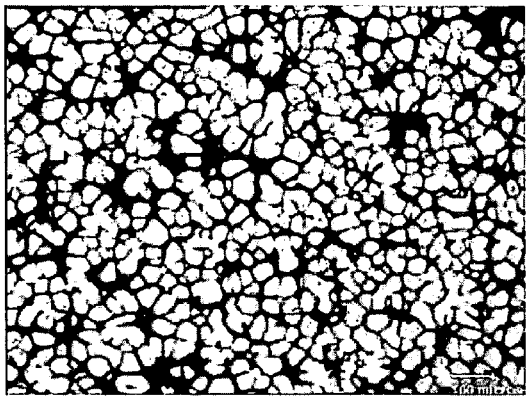
FIGS. 16A and 16B exhibit micrographs from experiment R3-1.
Figure 16B:
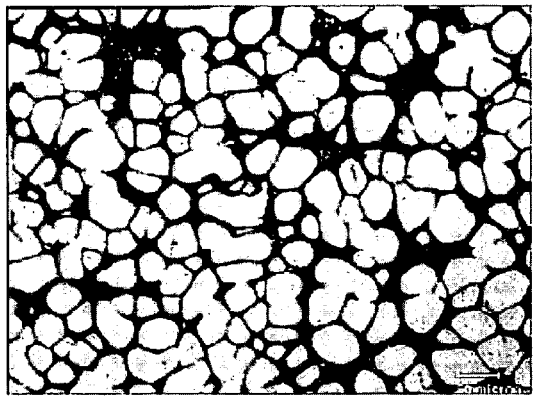

FIGS. 16A and 16B illustrate a micrograph from the R3-1 experiment. FIG. 16A is at 50× magnification, while FIG. 16B illustrates a 100× magnification. Among the rheocasting experiments, experiment R3-1 underwent the highest cooling rate through the SSM range (~−0.70° C./sec); thus its residence time within the two-phase field was the lowest (~0.5 min). This explains the small particle size observed in FIGS. 16A and 16B.

FIGS. 16A and 16B show primary particles in the range of 30-50 μm in diameter with a majority of the particles have a spherical shape. This is an important result because it shows that when a suitable receptacle temperature is chosen, the cooling rate through the two-phase field can be optimized, thus limiting grain growth and forming better SSM structures.

Figure 17A:
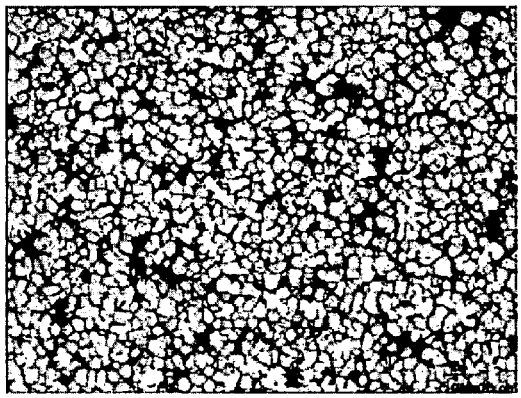
FIGS. 17A and 17B exhibit micrographs from experiment R3-4.
Figure 17B:
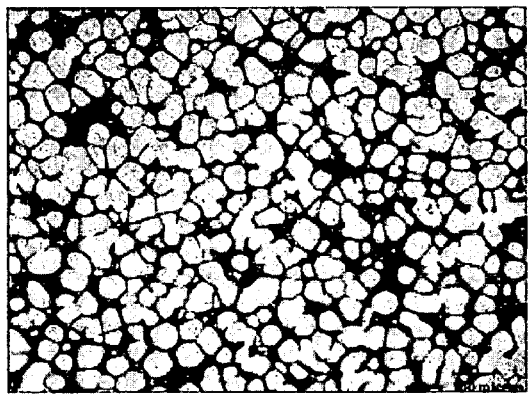
Figure 18A:
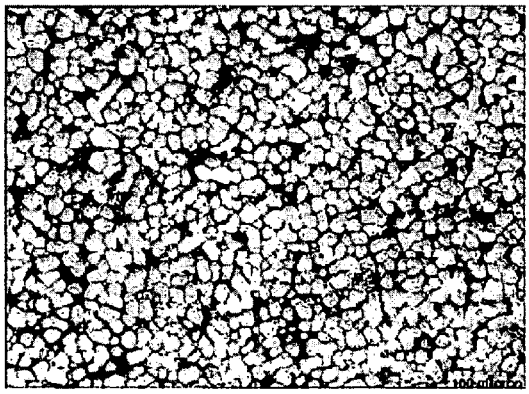
FIGS. 18A and 18B exhibit micrographs from experiment R3-5.
Figure 18B:
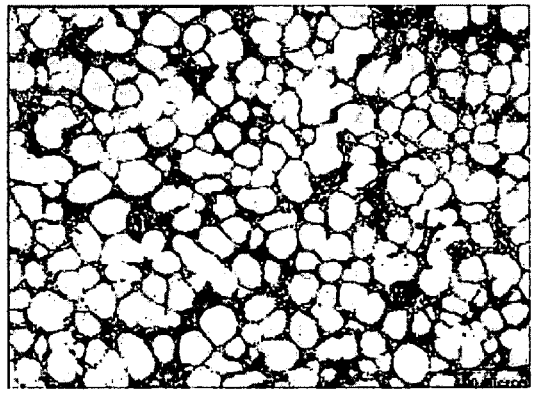

Experiments R3-4 and R3-5 were carried out in order to see the effect of using only one melt rather than two. All other experimental conditions were similar. FIGS. 17A and 17B illustrate a micrograph for experiment R3-4 (at 25× and 50× magnification, respectively) and FIGS. 18A and 18B show a micrograph for experiment R3-5 (at 25× and 50×, respectively).

Although the processing conditions for R3-4 and R3-5 were similar, the cooling rates (and hence residence times in the SSM range) were not the same. R3-4 had a cooling rate of about −0.24 C/sec and a residence time of about 1.5 minutes. R3-5 had a cooling rate of about −0.14 C/sec and a residence time of about 3.5 minutes. This explains the slightly larger overall particle size in the micrograph of FIG. 17B, since this sample was within the SSM range for about 2 minutes longer than in R3-4. Also, the temperature of the two slurries was about 586° C., which corresponds to a solid fraction of about 0.5. FIGS. 16A and 16B depict this solid fraction. It should be recalled that in experiment R2-2, the reported slurry temperatures and the observed solid fractions did not seem to match well. The results obtained with this alternate collection technique suggest that this was at least in part due to temperature variations between the thermocouple area and the extracted slurry area. The image analysis results from these three experiments are shown below in Table 11.

TABLE 11

| Experiment | Avg. Particle Diameter (μm) | Avg. Shape Factor | Number of particles analyzed |
|---|---|---|---|
| R3-1 | 35.2 | 0.83 | 155 |
| R3-4 | 49.5 | 0.85 | 308 |
| R3-5 | 63.1 | 0.75 | 269 |

It is concluded from these experiments that the third rheocasting approach, wherein the entire crucible's contents were quenched, led to globular slurry structures of even finer size. Using a higher cooling rate, particle size was minimized. The use of one melt rather than two does not noticeably affect the structures, although there should theoretically be less forced convection. This suggests that the level of forced convection in the reactor using one melt is sufficient for the formation of non-dendritic slurries.

EXAMPLE 6

Particle Size as a Function of Cooling Rates

Figure 19:
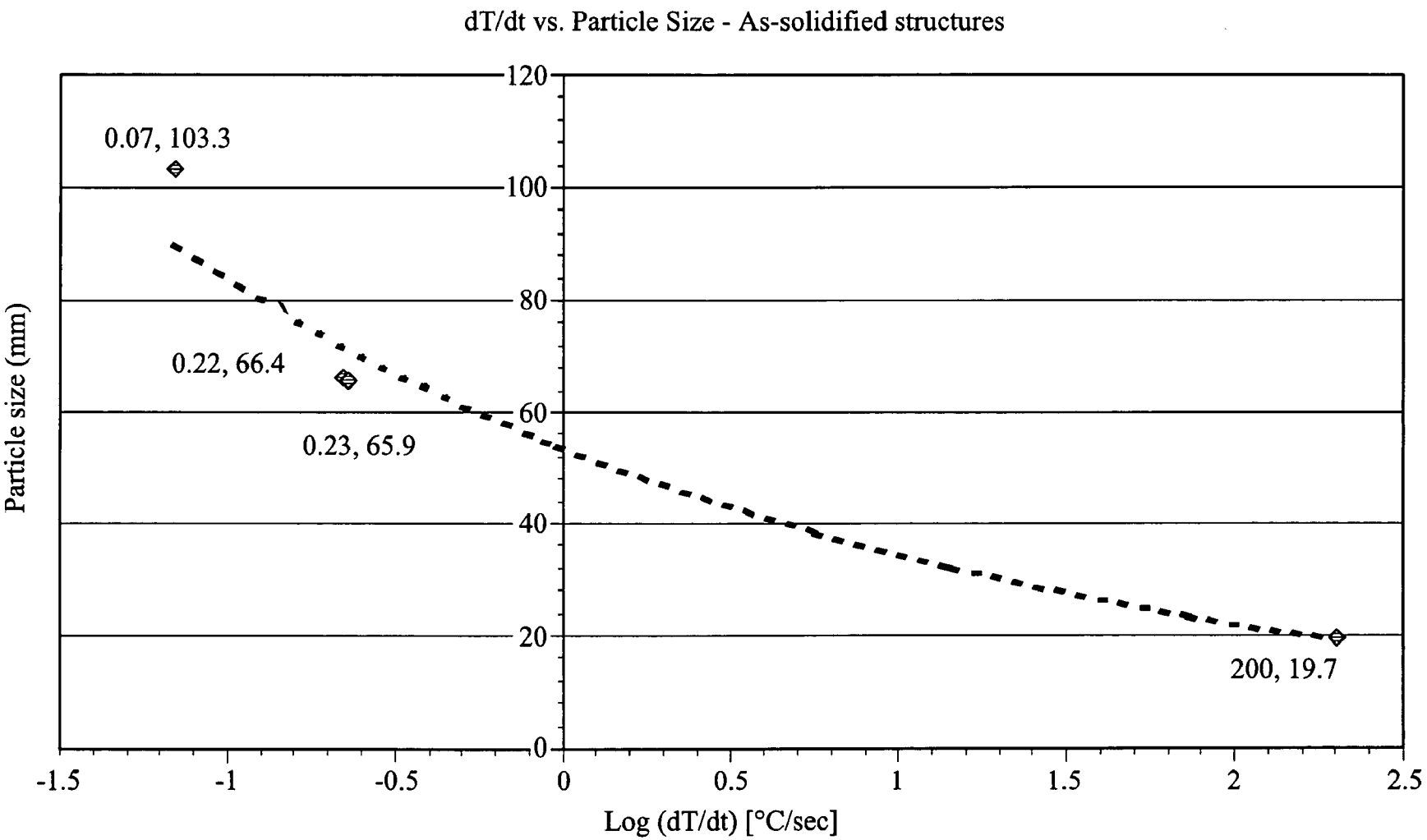
FIG. 19 is a graph of particle size in as-solidified structures as a function of cooling rate of the slurry after exiting the reactor.
Figure 20:
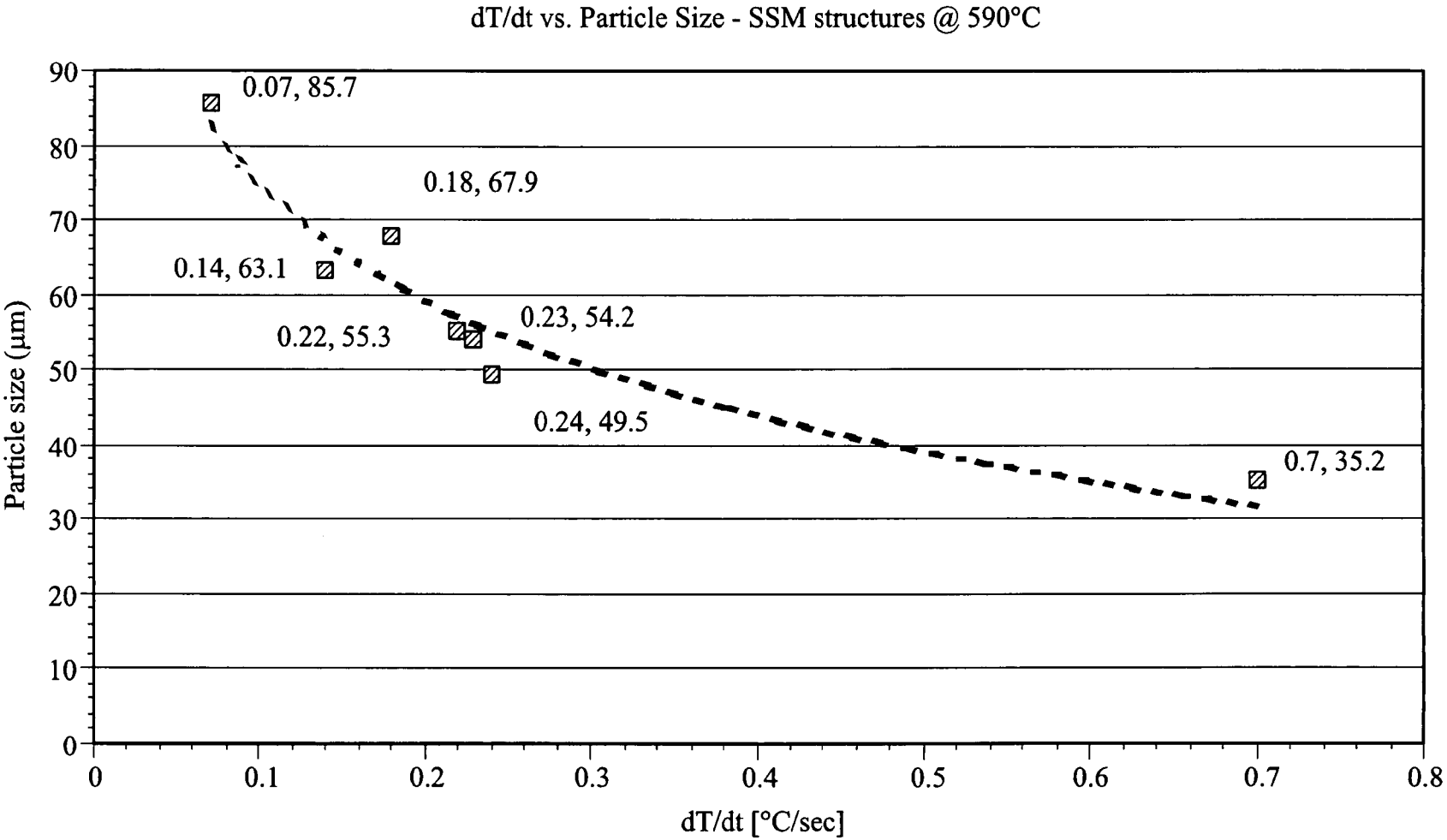
FIG. 20 is a graph of particle size in slurry structures at 590° C. as a function of cooling rate of the slurry after exiting the reactor.

FIGS. 19 and 20 illustrate data from selected rheocasting experiments showing particle size as a function cooling rates. Slower cooling rates through the SSM temperature range result in structures having larger particle diameters, while higher cooling rates lead to finer particle sizes. These results imply that in the rheocasting approach, an optimum cooling rate can be experimentally determined in order to yield highly refined and globular structures in the processed slurry. Such an optimum cooling rate, however, while leading to fine particle sizes, must be applied uniformly throughout the bulk of any given sized slurry bath. The data also suggest that the solid fraction of the processed slurry can be quickly adjusted prior to subsequent forming. From an industrial standpoint, this is highly desirable because uniform slurry structures, which directly impact the uniformity of thixotropic flow in a volume of slurry, can be realized. Furthermore, higher productivity can be achieved because shorter production times can result from faster thermal adjustment of the slurry prior to forming.

These experimental results clearly show that a high nucleation rate combined with turbulence and forced convection leads to (a) copious nucleation of the primary phase, (b) dispersal of nuclei throughout the bulk liquid, and (c) survival of nuclei due to a homogeneous temperature distribution. The high level of grain refinement observed in the as-solidified samples can be explained by numerous nucleation events within the reactor. The uniformity of these structures throughout the samples (as well as the degree of particle agglomeration) shows that these nuclei were dispersed effectively by the fluid flow in both the reactor and the receptacle. Survival of the majority of these nuclei "seeds," though difficult to verify quantitatively, is strongly suggested by the high nuclei densities seen in the microstructures.

EQUIVALENTS

While this invention has been particularly shown and described with references to preferred embodiments thereof, it will be understood by those skilled in the art that various changes in form and details may be made therein without departing from the scope of the invention encompassed by the appended claims.

What is claimed is:

1. A method for forming a semi-solid metal alloy, comprising:

a. superheating a metal alloy above the liquidus temperature of the metal alloy;

b. directing the superheated metal alloy into a nucleation reactor having a plurality of intersecting inner channels such that the metal alloy is directed into at least two intersecting inner channels;

c. passively mixing the superheated metal alloy via fluid impingement and convection within the nucleation reactor;

d. cooling the superheated alloy within the nucleation reactor to a temperature between a solidus temperature and a liquidus temperature of the alloy to form a plurality of nuclei, thereby producing a nucleated alloy; and e. passively mixing the nucleated alloy, via fluid impingement and convection in the nucleation reactor, at a temperature between the solidus temperature and the liquidus temperature of the alloy, without raising the temperature of the alloy to thereby prevent the nuclei from melting, thereby forming the semi-solid metal alloy.

2. The method of claim 1 wherein the nucleation reactor includes a first melt inlet, a second melt inlet, a first inner channel in fluid communication with the first melt inlet, and a second inner channel in fluid communication with the second melt inlet; wherein the first inner channel and the second inner channel intersect at a first junction and streams of the same superheated alloy flowing from the first inner channel and the second inner channel passively mix via fluid impingement and convection.

3. The method of claim 2 wherein the nucleation reactor further includes a third inner channel and a fourth inner channel that also intersect at the first junction and wherein the alloy separates into streams flowing into the third inner channel and the fourth inner channel.

4. The method of claim 3 wherein the third inner channel and the fourth inner channel intersect at a second junction downstream from the first junction and wherein streams of alloy flowing through the third inner channel and the fourth inner channel passively mix via fluid impingement and convection.

5. The method of claim 1 further comprising cooling the semi-solid metal alloy to a temperature below a solidus temperature of the semi-solid metal alloy.

6. The method of claim 1 wherein the superheated alloy is cooled at a rate of at least 15° C. per second to form the nucleated alloy.

7. The method of claim 6 wherein the superheated alloy is cooled at a rate in the range of about 20° C. per second to about 30° C. per second to form the nucleated alloy.

8. The method of claim 1 wherein the superheated alloy includes at least one of the materials selected from the group consisting of aluminum, lead, tin, magnesium, manganese, strontium, titanium, silicon, iron, carbon, copper, gold, silver, and zinc.

9. The method of claim 1 further including the step of using the semi-solid metal alloy in at least one application selected from the group consisting of thixocasting applications and rheocasting applications.

10. The method of claim 1 wherein the semi-solid metal alloy is substantially free of dendrites.

11. The method of claim 1 wherein the semi-solid metal alloy includes a primary particle size of about 100 microns or less.

12. The method of claim 11 wherein the semi-solid metal alloy includes a primary particle size of about 70 microns or less.

13. The method of claim 1 wherein the semi-solid metal alloy includes a shape factor value in the range of about 0.75 and about 0.95.

14. The method of claim 1 further including the step of molding the semi-solid metal alloy in a metal-forming process.

15. The method of claim 1 wherein the superheated alloy includes at least one grain-refining agent.

16. The method of claim 15 wherein the grain-refining agent includes at least one of the materials selected from the group consisting of borides of titanium and borides of aluminum.

17. The method of claim 15 wherein the grain-refining agent includes at least one of the materials selected from the group consisting of $TiB_2$, $AlB_2$, TiC, and $Al_3Ti$.

18. The method of claim 1 wherein the superheated alloy is cooled from a temperature at least about 5° C. above the liquidus temperature.

19. The method of claim 18 wherein the superheated alloy is cooled from a temperature in the range of between about 10° C. to about 15° C. above the liquidus temperature.

20. The method of claim 1 further including the step of forming a billet from the semi-solid metal alloy.

21. The method of claim 1 wherein at least a portion of the superheated alloy includes a metal or alloy recycled from a metal-forming process.

22. The method of claim 1 further including the step of directing the semi-solid metal alloy to a metal-forming process.

23. The method of claim 22 wherein the semi-solid metal alloy directed to a metal-forming process includes a volume fraction of solids of at least about 30%.

24. The method of claim 23 wherein the semi-solid metal alloy directed to a metal-forming process includes a volume fraction of solids in the range of from about 40% to about 60%.

25. A method for forming a semi-solid metal alloy, comprising:

a. superheating a metal alloy above the liquidus temperature of the metal alloy;

b. directing the superheated metal alloy into a nucleation reactor which includes:

i. a first melt inlet and a second melt inlet;

ii. a first inner channel in fluid communication with the first melt inlet and a second inner channel in fluid communication with the second melt inlet;

wherein the first inner channel and the second inner channel intersect at a first junction and wherein streams of the alloy flowing through the first inner channel and the second inner channel passively mix via fluid impingement and convection; and iii. a third inner channel and a fourth inner channel;

wherein the third inner channel and a fourth inner channel also intersect at the first junction and wherein the alloy separates into streams flowing into the third inner channel and the fourth inner channel and wherein the third inner channel and the fourth inner channel intersect at a second junction downstream from the first junction and wherein streams of alloy flowing through the third inner channel and the fourth inner channel passively mix via fluid impingement and convection;

wherein the superheated metal alloy is directed into both the first melt inlet and the second melt inlet of the nucleation reactor; and c. cooling the superheated alloy within the nucleation reactor to a temperature between a solidus temperature and a liquidus temperature of the alloy to form a plurality of nuclei and controlling the temperature of the alloy to prevent a substantial number of the nuclei from melting, thereby forming the semi-solid metal alloy.

26. The method of claim 25 further comprising cooling the semi-solid metal alloy to a temperature below a solidus temperature of the metal alloy.

27. The method of claim 25 wherein the first inner channel and the second inner channel intersect at the first junction at an angle of about 90°.

28. The method of claim 25 wherein the third inner channel and the fourth inner channel intersect at the second junction at an angle of about 90°.

29. A method for forming an semi-solid metal alloy, comprising:

a. directing a metal alloy, heated above the liquidus temperature of the metal alloy, into a nucleation reactor, the nucleation reactor having a plurality of intersecting inner channels such that the metal alloy is streamed into at least two intersecting inner channels;

b. impinging streams of the metal alloy directed into the at least two intersecting inner channels at an intersection thereof;

c. cooling the metal alloy within the nucleation reactor to a temperature between a solidus temperature and a liquidus temperature of the metal alloy to thereby form a plurality of nuclei, thereby forming a nucleated alloy; and d. passively mixing the nucleated alloy at a temperature between the solidus temperature and the liquidus temperature of the nucleated alloy, without raising the temperature of the alloy stream to thereby prevent the nuclei from melting, thereby forming the semi-solid metal alloy.

30. The method of claim 29 wherein the nucleation reactor includes:

a. a first melt inlet and a second melt inlet;

b. a first inner channel in fluid communication with the first melt inlet and a second inner channel in fluid communication with the second melt inlet;

wherein the first inner channel and the second inner channel intersect at a first junction and wherein a first stream of the alloy flowing through the first inner channel and a second stream of the same alloy flowing through the second inner channel passively mix via fluid impingement and convection; and c. a third inner channel and a fourth inner channel;

wherein the third inner channel and a fourth inner channel also intersect at the first junction and wherein the alloy separates into streams flowing into the third inner channel and the fourth inner channel and wherein the third inner channel and the fourth inner channel intersect at a second junction downstream from the first junction and wherein streams of alloy flowing through the third inner channel and the fourth inner channel passively mix via fluid impingement and convection.

31. The method of claim 30 wherein the first inner channel and the second inner channel intersect at the first junction at an angle of about 90°.

32. The method of claim 30 wherein the third inner channel and the fourth inner channel intersect at the second junction at an angle of about 90°.

33. The method of claim 29 further comprising cooling the semi-solid metal alloy to a temperature below a solidus temperature of the metal alloy.

* * * * *